US006280918B1

(12) United States Patent
Mikoshiba et al.

(10) Patent No.: US 6,280,918 B1
(45) Date of Patent: Aug. 28, 2001

(54) SILVER HALIDE PHOTOGRAPHIC LIGHTSENSITIVE MATERIAL

(75) Inventors: Hisashi Mikoshiba; Hidetoshi Kobayashi, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/396,944

(22) Filed: Sep. 15, 1999

(30) Foreign Application Priority Data

Sep. 29, 1998 (JP) ..... 10-290076

(51) Int. Cl.[7] ..... G03C 1/10
(52) U.S. Cl. ..... 430/546
(58) Field of Search ..... 430/546, 631

(56) References Cited

U.S. PATENT DOCUMENTS 5,104,450 * 4/1992 Sand et al. ..... 106/177
5,219,510 * 6/1993 Machell et al. ..... 264/210.6

* cited by examiner

*Primary Examiner*—Janet Baxter
*Assistant Examiner*—Amanda C. Walke

(74) *Attorney, Agent, or Firm*—Birch, Stewart, Kolasch & Birch, LLP

(57) ABSTRACT

A silver halide photographic lightsensitive material comprises at least one silver halide emulsion layer on a support and contains at least one noncolor-forming compound represented by the following general formula (1)

(1)

wherein each of $R_1$, $R_2$ and $R_3$ independently represents an alkyl group, an aryl group, a halogen atom, a heterocyclic group, a cyano group, a hydroxy group, a nitro group, a carboxyl group, a sulfo group, an amino group, an alkoxy group, an aryloxy group, an acylamino group, an alkylamino group, an anilino group, an ureido group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a sulfinyl group, an aryloxycarbonyl group or an acyl group, each of k and n independently represents an integer of 0 to 5, and m represents an integer of 0 to 4.

16 Claims, No Drawings

SILVER HALIDE PHOTOGRAPHIC LIGHTSENSITIVE MATERIAL

BACKGROUND OF THE INVENTION

The present invention relates to a silver halide photographic lightsensitive material. More particularly, the present invention relates to a silver halide photographic lightsensitive material in which a high-boiling-point organic solvent being excellent in dissolving power, dispersibility, dispersion stability, etc. is used to thereby attain improvement with respect to the deterioration of the color forming properties, and preservability of an emulsion or a latent image with the lapse of time. Hereinafter, a silver halide photographic lightsensitive material is also referred to as a lightsensitive material or sensitive material.

It is common practice to use a photographically useful compound that is sparingly soluble to water by dissolving it in an appropriate oil forming agent, namely a high-boiling-point organic solvent and dispersing the thus obtained solution in a solution of a hydrophilic organic colloid, for example, gelatin in the presence of a surfactant so that the photographically useful compound is contained in a hydrophilic organic colloid layer. Phthalic acid ester compounds and phosphoric acid ester compounds are generally used as the high-boiling-point organic solvent.

The following wide-ranging performances are required of the high-boiling-point organic solvent. For example, the high-boiling-point organic solvent should be excellent in the dissolving power of photographically useful compounds, affinity with gelatin, dispersibility and dispersion stability in gelatin, etc. The high-boiling-point organic solvent should not lower the reactivity of photographically useful compounds, for example, the color forming properties of couplers and the redox reactivity of redox compounds such as color mixing inhibitors. The high-boiling-point organic solvent should enable the optimal regulation of the hue of dyes formed by color forming reactions. The chemical stability of the high-boiling-point organic solvent per se should be excellent. The high-boiling-point organic solvent should not accelerate the decomposition of dispersed photographically useful compounds. The high-boiling-point organic solvent should not accelerate the fading of formed dyes by light, moisture and heat. The high-boiling-point organic solvent should not promote the phenomenon such that photographically useful compounds contained in the lightsensitive material and compounds which are present in processing liquids and, after the processing, remain in the lightsensitive material are decomposed by light, moisture or heat to result in coloring, i.e., staining. The high-boiling-point organic solvent should not shorten the storage life of an emulsion or a latent image. The high-boiling-point organic solvent should be cheap and should be easily procurable.

Phosphoric acid ester high-boiling-point organic solvents can be mentioned as the high-boiling-point organic solvent satisfying the above performance requirements. However, the conventional phosphoric a acid ester high-boiling-point organic solvents are unsatisfactory in various respects. In particular, the deterioration of a color forming properties of a coupler, of an emulsion storage life under humid and hot conditions, and of tone softening which are attributed to the migration of a high-boiling-point organic solvent in lightsensitive material with the laps of time, have been problems of the conventional phosphoric acid ester high-boiling-point organic solvents. Although the migration with the laps of time, can be restrained by the use of a high-boiling-point organic solvent which has a large molecular weight and is highly hydrophobic, the high-boiling-point organic solvent having a large molecular weight has a drawback in that the reactivity of photographically useful compounds such as the color forming properties of coupler is lowered. Thus, it has been difficult to reconcile the anti-diffusing properties and the reactivity for the high-boiling-point organic solvent.

The prior art will now further be described. Although bis type phosphoric acid esters are described in Jpn. Pat. Appln. KOKAI Publication No. (hereinafter referred to as JP-A-) 2-125254, JP-A's-2-282250, 5-313327, 61-200538, 62-9348, 63-314543 and U.S. Pat. No. 5,288,715, the structures of these described compounds are different from those of the phosphoric acid esters used in the present invention. In addition, the performances, such as the color forming properties, preservability and dispersibility of a photographic material in which the phosphoric acid esters of the above prior arts are used, were unsatisfactory.

Compounds whose structures are similar to that of the high-boiling-point organic solvent used in the present invention are described in U.S. Pat. Nos. 5,219,510 and 5,104,450. However, these patents only describe supports and mixtures with cellulose esters and are irrelevant to the silver halide photographic lightsensitive material of the present invention.

BRIEF SUMMARY OF THE INVENTION

A first object of the present invention is to provide a lightsensitive material in which use is made of a high-boiling-point organic solvent having a high dissolving power and being excellent in dispersibility and dispersion stability. A second object of the present invention is to provide a lightsensitive material having improved color image fastness and reduced staining. A third object of the present invention is to provide a lightsensitive material in which an emulsion improved in fog and tone softening caused with the lapse of time, is used. A fourth object of the present invention is to provide a lightsensitive material in which preservability of latent images is improved. A fifth object of the present invention is to provide a lightsensitive material improved in the deterioration of color forming properties with the lapse of time. A sixth object of the present invention is to provide a lightsensitive material by which various adverse actions attributed to the migration of a dispersion medium with the lapse of time, is suppressed. A seventh object of the present invention is to proved a lightsensitive material using a high-boiling-point organic solvent that is cheap and readily available, by which problems attributed to conventional high-boiling-point organic solvents are solved.

DETAILED DESCRIPTION OF THE INVENTION

The inventors have conducted extensive and intensive studies with respect to phosphoric acid ester compounds having large molecular weights. As a result, it has been found that a bis type aryl phosphoric acid ester high-boiling-point organic solvents having specified structures can reconcile the anti-diffusing properties and the reactivity, and can satisfactorily accomplish all the performances that are required to have as the high-boiling-point organic solvent for use in the lightsensitive material. The present invention has been completed on the basis of this finding.

That is, the above objects can be attained by a silver halide photographic lightsensitive material comprising at least one silver halide emulsion layer on a support, wherein at least one noncolor-forming compound represented by the following general formula (1) is contained.

(1)

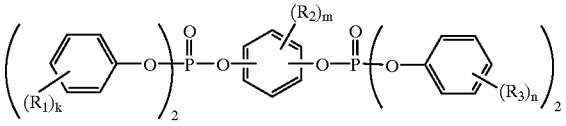

In the formula, each of $R_1$, $R_2$ and $R_3$ independently represents and alkyl group, a linear or branched alkenyl group having 2 to 32 carbon atoms, a linear or branched alkynyl group having 2 to 32 carbon atoms, a cycloalkyl group having 3 to 32 carbon atoms, a cycloalkenyl group having 3 to 32 carbon atoms, an aryl group, a halogen atom, a heterocyclic group, a cyano group, a hydroxy group, a nitro group, a carboxyl group, a sulfo group, an amino group, an alkoxy group, an aryloxy group, an acylamino group, an alkylamino group, an anilino group, an ureido group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a sulfinyl group, an aryloxycarbonyl group or an acyl group. When k is two or more, two of $R_1$'s may bond together to form a 5- or 6-membered carbon ring or a 5- or 6-membered heterocyclic ring. When n is two or more, two of $R_3$'s may bond together to form a 5- or 6-membered carbon ring or a 5- or 6-membered heterocyclic ring.

Each of k and n independently represents an integer of 0 to 5. m is an integer of 0 to 4.

The present invention will be described in detail below.

In the general formula (1), each of $R_1$, $R_2$ and $R_3$ independently represents an alkyl group, a linear or branched alkenyl group having 2 to 32 carbon atoms, a linear or branched alkynyl group having 2 to 32 carbon atoms, a cycloalkyl group having 3 to 32 carbon atoms, a cycloalkenyl group having 3 to 32 carbon atoms, and aryl group, a halogen atom, a heterocyclic group, a cyano group, a hydroxy group, a nitro group, a carboxyl group, a sulfo group, an amino group, an alkoxy group, an aryloxy group, an acylamino group, an alkylamino group, an anilino group, an ureido group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a sulfinyl group, an aryloxycarbonyl group or an acyl group.

More specifically, each of $R_1$, $R_2$ and $R_3$ independently represents a substituted or unsubstituted alkyl group, for example, a substituted or unsubstituted linear or branched alkyl group having 1 to 32 carbon atoms, specific examples thereof including methyl, ethyl, propyl, isopropyl, t-butyl and n-tridecyl; a substituted or unsubstituted alkenyl group, for example, a substituted or unsubstituted linear or branched alkenyl group having 2 to 32 carbon atoms, specific examples thereof including allyl and oleyl; a substituted or unsubstituted alkynyl group, for example, a substituted or unsubstituted linear or branched alkynyl group having 2 to 32 carbon atoms, specific examples thereof including 1-propyn-1-yl; a substituted or unsubstituted cycloalkyl group, for example, a substituted or unsubstituted cycloalkyl group having 3 to 32 carbon atoms, specific examples thereof including cyclohexyl; a substituted or unsubstituted cycloalkenyl group, for example, a substituted or unsubstituted cycloalkenyl group having 3 to 32 carbon atoms; an aryl group, for example, a substituted or unsubstituted aryl group having 6 to 30 carbon atoms, specific examples thereof including phenyl, naphthyl and p-chlorophenyl; a halogen atom, for example, a chlorine atom, a bromine atom and an iodine atom; a heterocyclic group, for example, a substituted or unsubstituted heterocyclic group having 3 to 20 carbon atoms, preferably the hetero atom of which is/are one or more nitrogen atoms, oxygen atoms or sulfur atoms, specific examples thereof including, imidazolyl, pyrazolyl and triazolyl; a cyano group; a hydroxy group; a nitro group; a carboxyl group; a sulfo group; an amino group; an alkoxy group, for example, a substituted or unsubstituted alkoxy group having 1 to 20 carbon atoms, specific examples thereof including methoxy, ethoxy, methoxyethoxy and 2-dodecylethoxy; an aryloxy group, for example, a substituted or unsubstituted aryloxy group having 6 to 20 carbon atoms, specific examples thereof including phenoxy and p-methoxyphenoxy; an acylamino group, for example, a substituted or unsubstituted acylamino group having 1 to 20 carbon atoms, specific examples thereof including acetylamino, pivaloylamino and benzoylamino; an alkylamino group, for example, a substituted or unsubstituted alkylamino group having 1 to 30 carbon atoms, specific examples thereof including methylamino, diethylamino and hexadecylamino; an anilino group, for example, a substituted or unsubstituted anilino group having 6 to 30 carbon atoms, specific examples thereof including N-methylanilino and N-hexadecylanilino; an ureido group, for example, a substituted or unsubstituted ureido group having 1 to 20 carbon atoms, specific examples thereof including methylaminocarbonylamino; an alkylthio group, for example, a substituted or unsubstituted alkylthio group having 1 to 20 carbon atoms, specific examples thereof including methylthio, ethylthio and tetradecylthio; an arylthio group, for example, a substituted or unsubstituted arylthio group having 6 to 20 carbon atoms, specific examples thereof including, phenylthio and naphthylthio; an alkoxycarbonylamino group, for example, a substituted or unsubstituted alkoxycarbonylamino group having 2 to 20 carbon atoms, specific examples thereof including methoxycarbonylamino, ethoxycarbonylamino and octyloxycarbonylamino; a sulfonamido group, for example, a substituted or unsubstituted sulfonamido group having 1 to 20 carbon atoms, specific examples thereof including methanesulfonylamino, benzenesulfonylamino and toluenesulfonylamino; a carbamoyl group, for example, a substituted or unsubstituted carbamoyl group having 1 to 20 carbon atoms, specific examples thereof including aminocarbonyl and methylaminocarbonyl; a sulfamoyl group, for example, a substituted or unsubstituted sulfamoyl group having 1 to 20 carbon atoms, specific examples thereof including methylaminosulfonyl and octylaminosulfonyl; a sulfonyl group, for example, a substituted or unsubstituted sulfonyl group having 1 to 20 carbon atoms, specific examples thereof including methanesulfonyl, dodecanesulfonyl and toluenesulfonyl; an alkoxycarbonyl group, for example, a substituted or unsubstituted alkoxycarbonyl group having 2 to 20 carbon atoms, specific examples thereof including methoxycarbonyl, ethoxycarbonyl and isopropoxycarbonyl; a heterocyclic oxy group, for example, a substituted or unsubstituted heterocyclic oxy group having 1 to 20 carbon atoms, preferably the hetero atom of which is/are one or more nitrogen atoms, oxygen atoms or sulfur atoms, specific examples thereof including 1-phenyltetrazol-5-oxy and 2-tetrahydropyranyloxy; an azo group, for example, a substituted or unsubstituted azo group having 3 to 20 carbon atoms, specific examples thereof including phenylazo; an acyloxy group, for example, a substituted or unsubstituted acyloxy group having 1 to 20 carbon atoms, specific examples thereof including acetyloxy or pivaloyloxy; a carbamoyloxy group, for example, a substituted or unsubstituted carbamoyloxy group having 1 to 20 carbon atoms, specific examples thereof including dimethylaminocarbonyloxy; a silyloxy group, for example, a substituted or unsubstituted silyloxy group having 1 to 20 carbon atoms, specific examples thereof including trimethylsilyloxy; an aryloxycarbonylamino group, for example a substituted or unsubstituted aryloxycarbonylamino group having 6 to 20 carbon atoms, specific examples thereof including phenoxycarbonylamino; an imido group, for example, a substituted or unsubstituted imido group having 1 to 20 carbon atoms, specific examples thereof including phthalimido; a sulfinyl group, for example, a substituted or unsubstituted sulfinyl group having 1 to 20 carbon atoms, specific examples thereof including methanesulfinyl and dodecanesulfinyl; an aryloxycarbonyl group, for example, a substituted or unsubstituted aryloxycarbonyl group having 7 to 20 carbon atoms, specific examples thereof including phenoxycarbonyl; or an acyl group, for example, a substituted or unsubstituted acyl group having 1 to 20 carbon atoms, specific examples thereof including acetyl, pivaloyl and benzoyl.

When each of the substituents is an unsubstituted group, the terminology "n to m carbon atoms" used herein means the number of all carbon atoms possessed by that group is n to m. On the other hand, when each of the substituents is a substituted group, the terminology "n to m carbon atoms" used herein means the number of carbon atoms constituting skeletal portion, not including the number of carbon atoms possessed by the group attached to the skeletal portion of the substituent, is n to m.

When each of the substituents is a substituted group, the group used in the substitution can be, for example, an alkyl group, an aryl group, a halogen atom, a heterocyclic group, a cyano group, a hydroxy group, a nitro group, a carboxyl group, a sulfo group, an amino group, an alkoxy group, an aryloxy group, an acylamino group, an alkylamino group, an anilino group, an ureido group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a sulfinyl group, an aryloxycarbonyl group or an acyl group. Specifically, the group used in the substitution can be, for example, methyl, ethyl, isopropyl, phenyl, a chlorine atom, a bromine atom, pyrazolyl, cyano, hydroxy, nitro, carboxyl, sulfo, amino, methoxy, ethoxy, phenoxy, acetylamino, pivaloylamino, methylamino, diethylamino, anilino, methylaminocarbonylamino, methylthio, phenylthio, methoxycarbonylamino, methanesulfonylamino, methylaminocarbonyl, methylaminosulfonyl, methanesulfonyl, methoxycarbonyl, 1-phenyltetrazol-5-oxy, phenylazo, acetyloxy, dimethylaminocarbonyloxy, trimethylsilyloxy, phenoxycarbonyloxy, phthalimido, methanesulfinylphenoxycarbonyl or acetyl.

It is preferred that $R_1$ and $R_3$ be the same to each other.

It is also preferred that each of $R_1$, $R_2$ and $R_3$ represents an alkyl group, more preferably an unsubstituted alkyl group having 1 to 5 carbon atoms, for example, methyl, ethyl, isopropyl and t-butyl; an aryl group, more preferably an aryl group having 6 to 10 carbon atoms, for example, phenyl; an alkoxy group, more preferably an alkoxy group having 1 to 5 carbon atoms, for example, methoxy and ethoxy; or a halogen atom, more preferably a chlorine atom and a bromine atom.

Of these, methyl, ethyl, phenyl, methoxy and a chlorine atom are much more preferred.

The substitution position with each of $R_1$, $R_2$ and $R_3$, if any, may be conducted at any of o-, m- and p-positions to the oxygen atom directly bonded with phosphorus atom. It is preferred that the $R_1$ and $R_3$ substitution positions be the same to each other.

Use can be made of a mixture of such position isomers. This mixture is preferred from the viewpoint of dissolving power.

Each of k and n independently represents an integer of 0 to 5. m is an integer of 0 to 4.

It is preferred that each of k and n be 0 or 1, and that m also be 0 or 1. It is more preferred that k=n and the substitution position of $(R_1)_k$, if any, with respect to the position of the oxygen atom of

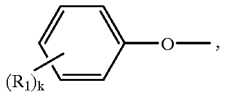

is the same as the substitution position of $(R_3)_n$, if any, with respect to the position of the oxygen atom of

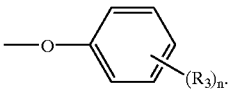

The substitution positions of the groups:

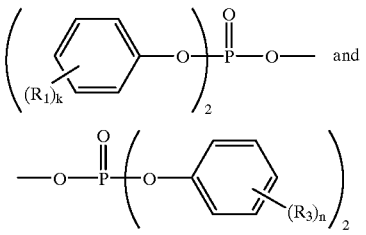

to the benzene ring to make a phenylene group can be any one of o-, m- and p-positions to each other. Of these, a m-phenylene group is preferred. In this preferred case, the substitution position of $R_2$ is preferably an opposition with respect to the position of the oxygen atom (left hand side) of

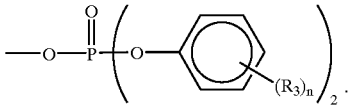

Of the compounds of the general formula (1), those in which each of $R_1$ and $R_3$ is phenyl, methoxy or a chlorine atom; $R_2$ is methyl, methoxy or a chlorine atom; k and n are the same with each other and each thereof is 0 or 1; and m is 0 or 1 are more preferred.

Among them, compound example 2 set forth below is much more preferred.

Compound examples as the high-boiling-point organic solvent for use in the present invention are listed below, however the present invention is not limited to these.

1

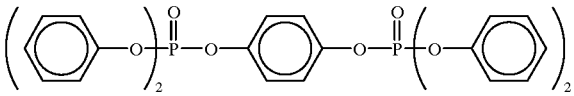

2

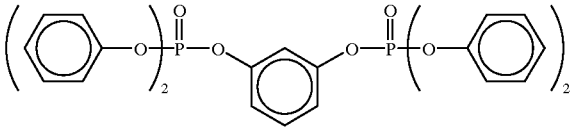

3

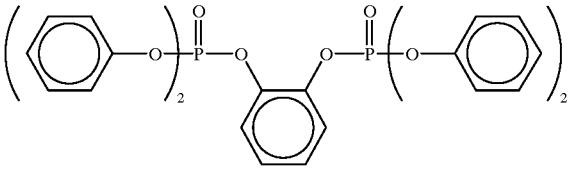

4

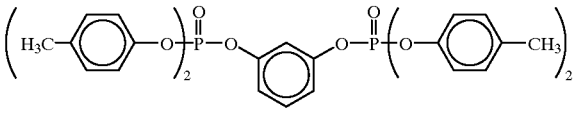

-continued

5

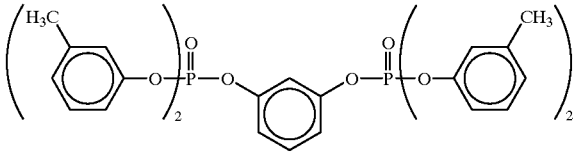

6

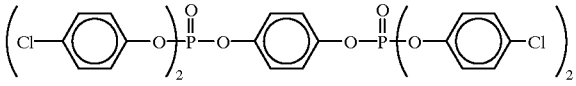

7

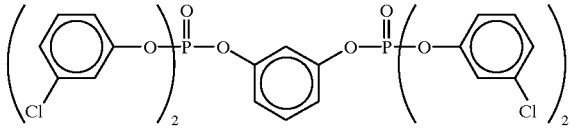

8

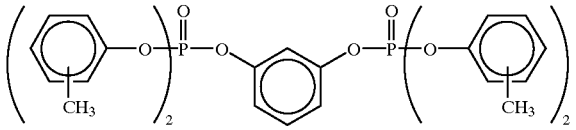

A mixture of a compound having each of the methyl groups at a m-position and a compound having each of the methyl groups at a p-position, relative to the oxygen atom.

9

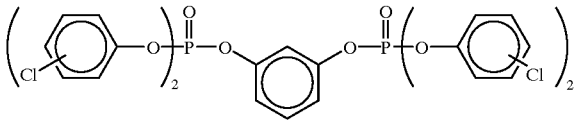

A mixture of a compound having each of the chlorine atoms at a o-position, a compound having each of the chlorine atoms at a m-position and a compound having each of the chlorine atoms at a p-position, relative to the oxygen atom.

10

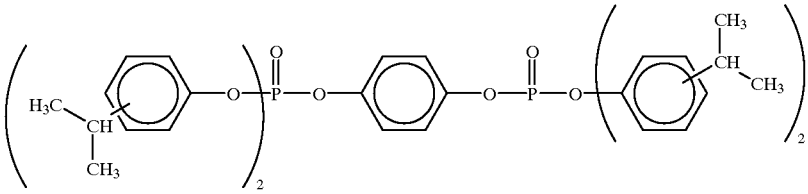

A mixture of a compound having each of the isopropyl groups at a o-position, a compound having each of the isopropylgroups at a m-position and a compound having each of the isopropylgroups at a p-position, relative to the oxygen atom.

11

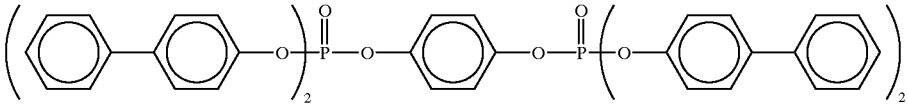

12

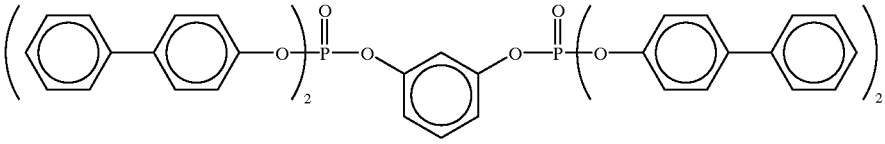

13

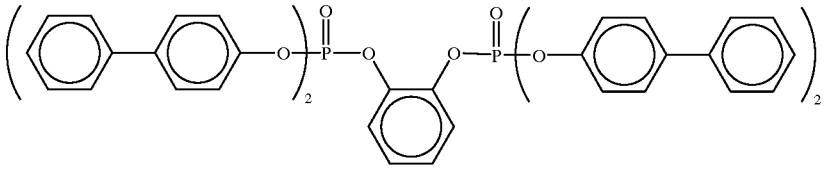

14

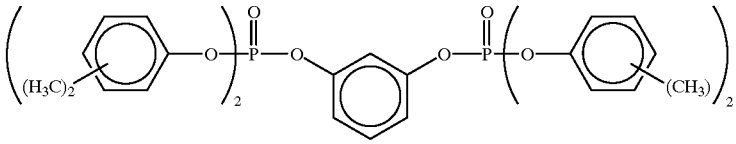

A mixture of a compound having each of the methyl groups at a o-position, a compound having each of the methyl groups at a m-position and a compound having each of the methyl groups at a p-position, relative to the oxygen atom.

(15)

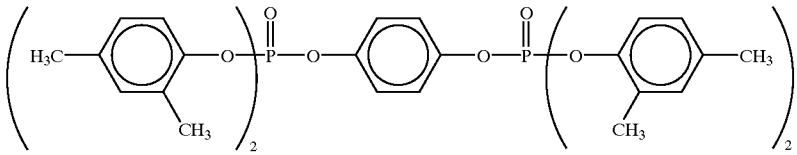

(16)

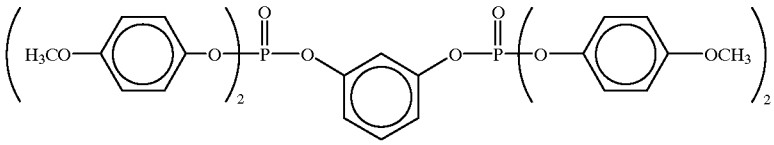

-continued
(17)
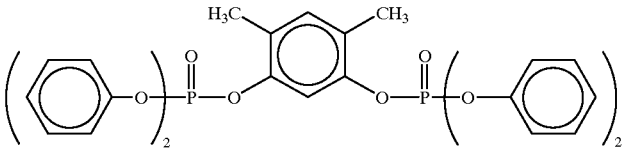
(18)
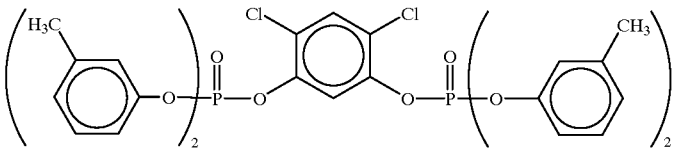
(19)
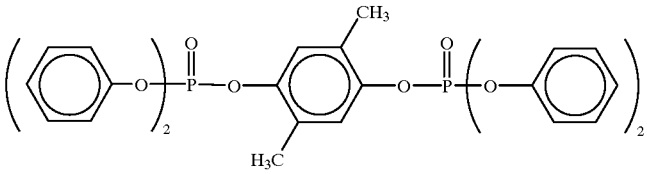
(20)
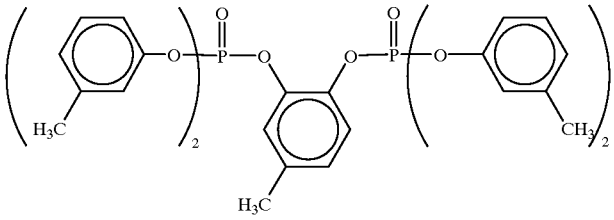
(21)
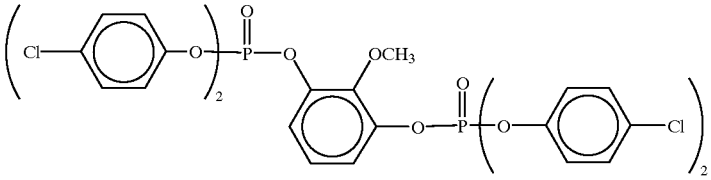
(22)
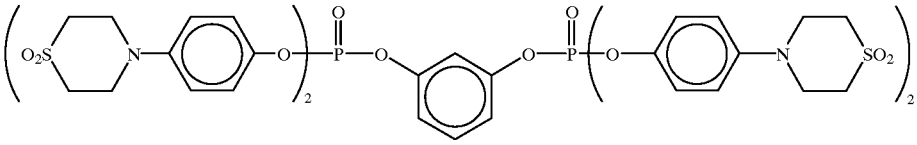
(23)
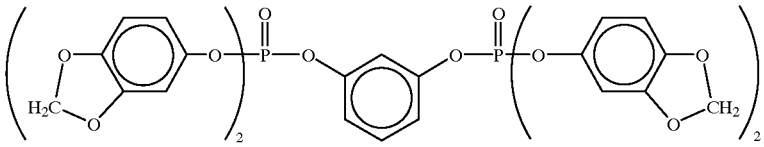
(24)
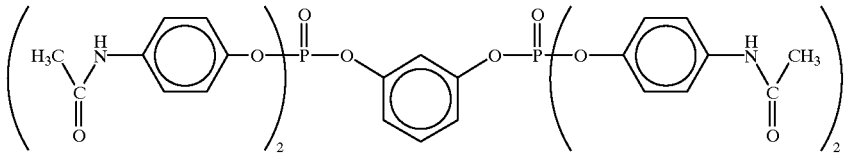

-continued
(25)
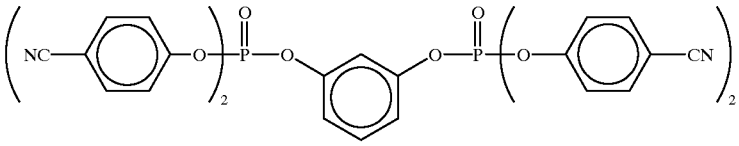
(26)
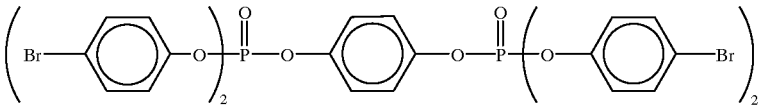
(27)
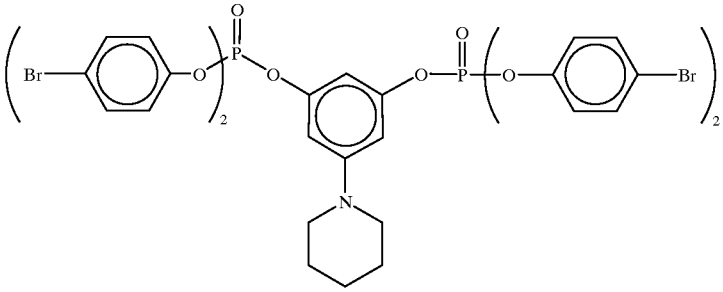
(28)
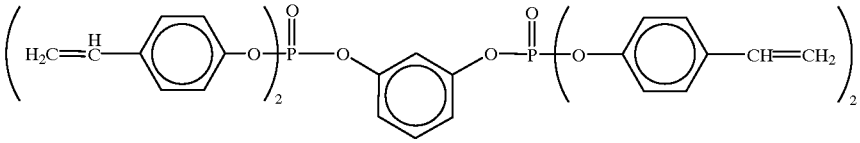
(29)
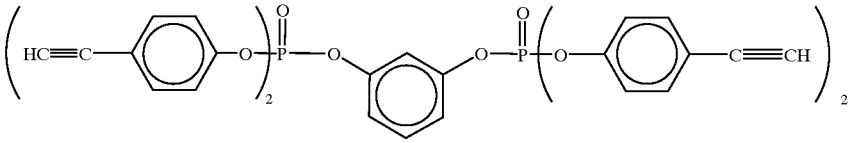
(30)
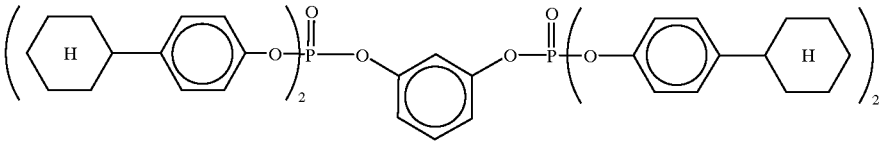
(31)
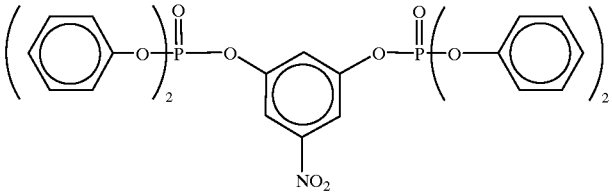
(32)
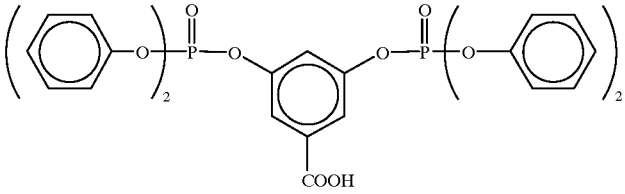

The process for synthesizing the compound represented by the general formula (1) will be described below.

The compound of the present invention can be easily synthesized by the customary process for synthesizing a phosphoric acid ester. This process will be described in detail below.

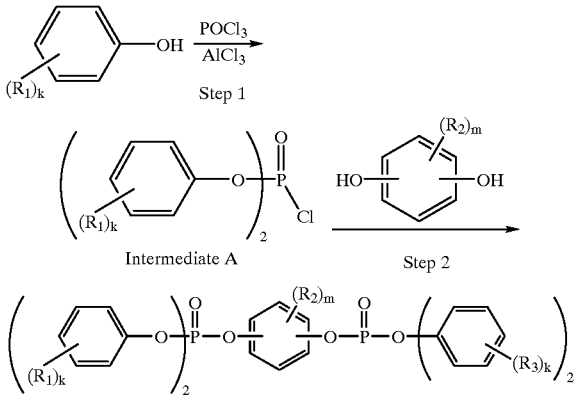

The compound represented by formula (1) of the present invention can be synthesized by reacting a phenol derivative with phosphorus oxychloride to thereby obtain intermediate A and thereafter reacting the intermediate A with a dihydroxybenzene derivative.

<Step 1>

The phenol derivative is preferably used in an amount of 1.5 to 3 equivalents, more preferably 1.8 to 2.2 equivalents, relative to phosphorus oxychloride. No solvent is used, or use can be made of an aromatic solvent (e.g., toluene, xylene), a nitrile solvent (e.g., acetonitrile, propionitrile ), sulfolane or a hydrocarbon solvent (e.g., octane). The reaction temperature is preferably in the range of 0 to 200° C., more preferably 20 to 80° C. For accelerating the reaction, a Lewis acid (e.g., aluminum chloride) can be used.

<Step 2>

Dihydroxybenzene is preferably used in an amount of 0.2 to 1.5 equivalents, more preferably 0.3 to 0.8 equivalent, relative to intermediate A that is obtained in Step 1 above. The same solvent as described in Step 1 can be used as the reaction solvent. For accelerating the reaction, a base can be used. An organic base (e.g., triethylamine or pyridine) is preferably used as the base. The reaction temperature is preferably in the range of 30 to 200° C., more preferably 80 to 150° C.

One of the compounds represented by the general formula (1) of the present invention is commercially available as Reofos RDP (CAS. NO. 57583-54-7, which corresponds to Compound 2 of the invention, produced by Ajinomoto Co., Inc.) and can be procured at low cost.

The compounds represented by the general formula (1) of the present invention each do not undergo a coupling reaction with a developing agent in an oxidized form to produce a dye and are noncolor forming compounds. Thus, the compounds represented by the general formula (1) of the present invention do not have any coupler residues in the molecular structure thereof.

The use amount of the compounds represented by the general formula (1) of the present invention can be changed in accordance with the object. The use amount is preferably in the range of 0.2 mg to 20 g, more preferably 1 mg to 5 g, per $m^2$ of the lightsensitive material of the invention. The weight ratio of the compound represented by the general formula (1) of the invention, to a photographically useful agent such as a coupler is generally in the range of 0.1 to 4, preferably 0.1 to 2. Examples of the photographically useful agent other than a coupler include a light fading preventing agent, a dark, heat fading preventing agent, a stain preventing agent, a color mixing inhibitor, a UV absorbent, a dye, which is used for prevention of irradiation or halation, a compound that releases a photographically useful compound during processing, e.g., a so to called block compound, a DIR hydroquione and a dye-releasing redox compound. The use amount in a layer of a dispersion comprising the compound represented by the general formula (1) of the present invention and the photographically useful agent relative to a dispersion medium is in the range of 2 to 0.1, preferably 1.0 to 0.2, per dispersion medium on a weight basis. Representative example of suitable dispersion mediums is gelatin, and hydrophilic polymers such as polyvinyl alcohol can be mentioned as the dispersion medium. The dispersion of the present invention can contain not only the above photographically useful agent but also other various compounds in accordance with the object.

The compounds represented by the general formula (1) of the present invention can be used either individually or in combination. When the compounds are used in combination, the use of a mixture of position isomers with respect to $R_1$, $R_2$ and $R_3$ is preferred from the viewpoint of dissolving power, as aforementioned.

The compounds represented by the general formula (1) of the present invention can be added in the same manner as employed in the addition of conventional high-boiling-point solvents to lightsensitive materials.

The compounds represented by the general formula (1) of the present invention can be incorporated in any of hydrophilic colloid layers to which a photographically useful compound that uses, as a solvent, the compounds represented by the general formula (1) of the present invention. Specifically, the compound represented by the general formula (1) of the present invention can be added to at least one of red-sensitive emulsion layers, green-sensitive emulsion layers and blue-sensitive emulsion layers.

The compounds represented by the general formula (1) of the present invention can be used in combination with conventionally known high-boiling-point organic solvents that are outside the scope of the formula (1) of the invention.

When use is made in combination with conventional high-boiling-point organic solvents, the compounds represented by the general formula (1) are preferably used in an amount of at least 10%, more preferably at least 30%, in terms of the weight ratio to the total high-boiling-point organic solvents.

Examples of the high-boiling-point solvents which can be used in combination with the compounds represented by the general formula (1) of the present invention are listed below.

$O = P(\text{-}OAr)_3$

Ar =

(1)

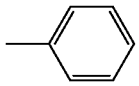

(2)

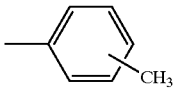

-continued (3)

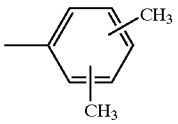

(4)

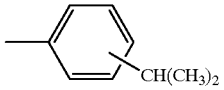

(5)

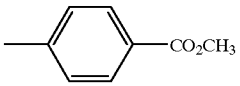

(6)

—n-$C_4H_9$ (7)

—n-$C_6H_{13}$ (8)

—$CH_2CH(C_2H_5)CH_2CH_2CH_2CH_3$ (This group is hereinafter referred to as 2EH.)

(9)

—$CH_2CH(CH_3)CH_2C(CH_3)_3$ (10)

—n-$C_{12}H_{25}$

Ar =

(11)

—$(CH_2)_8CH{=}CH(CH_2)_7CH_3$ (12)

—n-$C_{16}H_{33}$ (13)

—$CH(CH_3)CH_2Cl$ (14)

—$CH_2CH_2Cl$ (15)

—$CH_2CH_2O$—n-$C_4H_9$ (16)

—$CH_2CHClCH_2Cl$ (17)

—$CH(CH_2Cl)_2$ (18)

—$CH_2C(CH_2Br)_3$ (19)

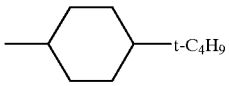

(20)

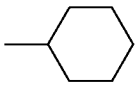

(21)

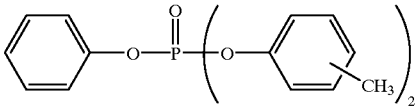

(22)

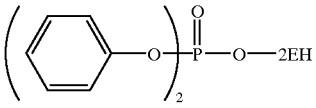

-continued (23)

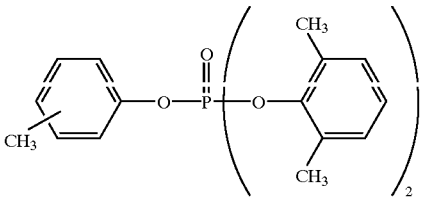

RA—OCO$(CH_2)_r$—$CO_2$RA

| RA = | r = |
|---|---|
| (24) —n-$C_8H_{17}$ | 7 |
| (25) —$CH_3$ | 8 |
| (26) —n-$C_4H_9$ | 8 |
| (27) —n-$C_8H_{17}$ | 8 |
| (28) —n-$C_8H_{17}$ | 4 |
| (29) —i-$C_9H_{19}$ | 4 |
| (30) —n-$C_4H_9$ | 4 |
| (31) —$CH(CH_3)_2$ | 4 |
| (32) —2EH | 4 |
| (33) —$C_{10}H_{21}$ | 4 |
| (34) —$CH_2CH_2OCH_2CH_2O$—n-$C_4H_9$ | 4 |

(35)

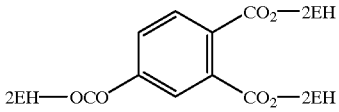

(36)

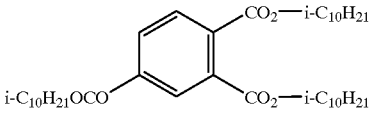

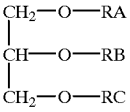

| RA = | RB = | RC = |
|---|---|---|
| (37) —$COCH_3$ | —$COCH_3$ | —CO—n-$C_{13}H_{27}$ |
| (38) —$COCH_3$ | —$COCH_3$ | —CO—n-$C_{15}H_{31}$ |
| (39) —$COCH_3$ | —$COCH_3$ | —CO—n-$C_{17}H_{35}$ |
| (40) —$COCH_3$ | —H | —CO—n-$C_{17}H_{35}$ |

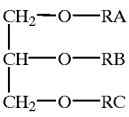

-continued
| | RA = | RB = | RC = |
|---|---|---|---|
| (41) | —CO—n-$C_9H_{19}$ | —CO—n-$C_9H_{19}$ | —CO—n-$C_9H_{19}$ |
| (42) | H | H | —CO—n-$C_{13}H_{27}$ |
| (43) | H | H | —CO—n-$C_{15}H_{31}$ |
| (44) | H | H | —CO—n-$C_{17}H_{35}$ |
| (45) | H | H | —CO—n-$C_{17}H_{33}$ (Oleyl) |
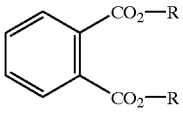
R =
(46) —n-$C_4H_9$
(47) —i-$C_7H_{15}$
(48) —2EH
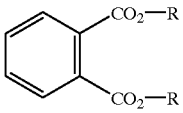
R =
(49) —n-$C_{12}H_{25}$
(50) —$C(C_2H_5)_3$
(51)
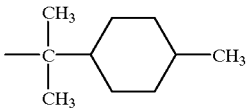
(52)
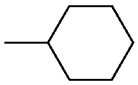
(53)
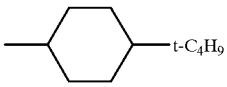
(54) —n-$C_8H_{17}$
(55) —$CH_2CH_2CH(CH_3)CH_2CH_2CH_2CH(CH_3)_2$
(56) —i-$C_{10}H_{21}$
(57) —i-$C_9H_{19}$
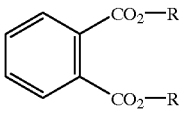
-continued
R =
(58) —i-$C_{11}H_{23}$
(59) —n-$C_5H_{11}$
(60) —n-$C_6H_{13}$
(61) —n-$C_3H_7$
(62)
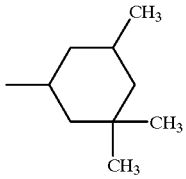
(63)
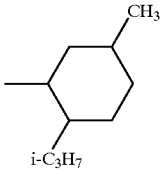
(64) —$CH_2CH_2O$—n-$C_4H_9$
(96)
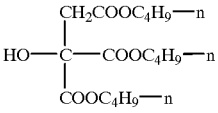
(97)
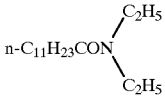
(98)
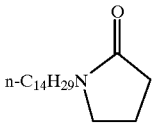
(99)
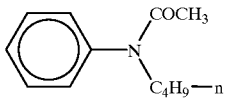
(100)
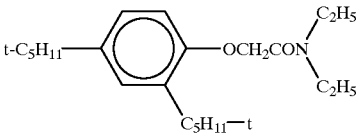

-continued
(101)
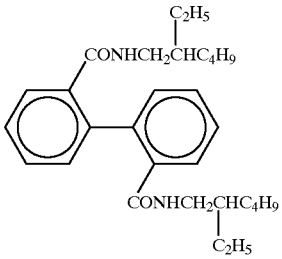
(102)
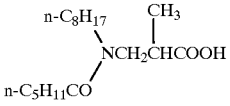
(103)
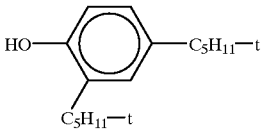
(104)
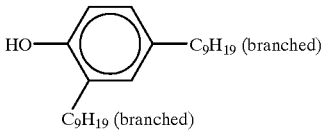
(105)
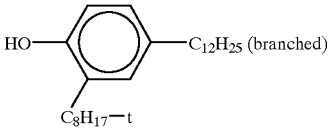
(106)
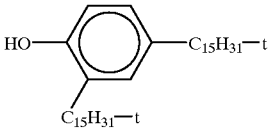
(107)
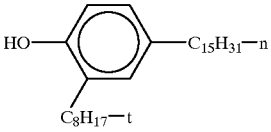
(108)
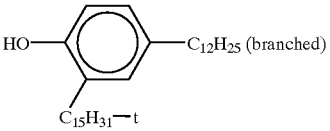
(109)
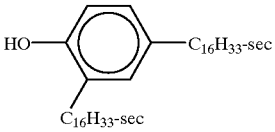
(110)
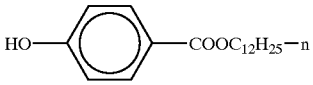
-continued
(111)
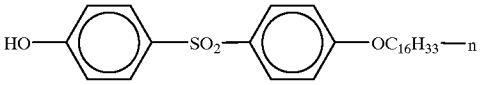
(112)
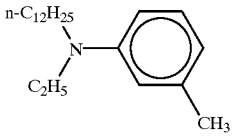
(113)
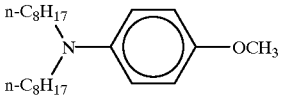
(114)
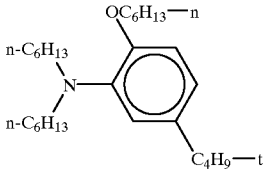
(115)
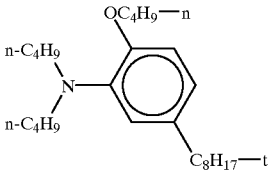
(116)
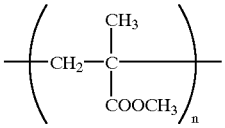
(Av. mol. wt: 20,000)
(117)
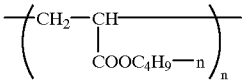
(Av. mol. wt: 50,000)
(118)
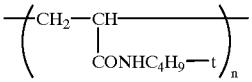
(Av. mol. wt: 60,000)
(119)
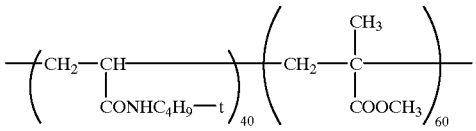
(Av. mol. wt: 40,000)
(120)
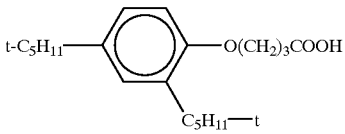

-continued (121)

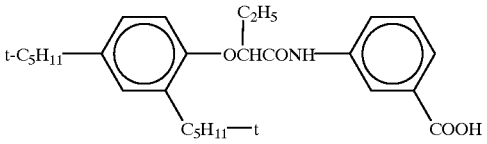

(122)

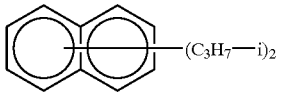

(123)

$C_nH_{2n+2}$ (A mixture of n-paraffins each having n = 14 or 15)

(124)

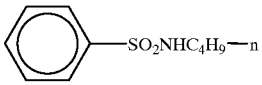

(125)

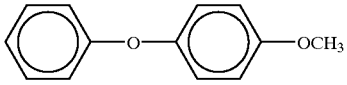

(126)

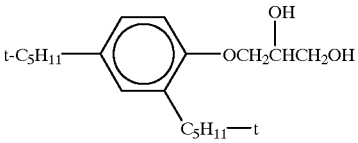

(127)

Chlorinated paraffin (Av. Composition $C_{14}H_{24}Cl_6$)

(128)

Chlorinated paraffin (Av. Composition $C_{12}H_{18}Cl_8$)

(129)

Poly(chlorotrifluoroethylene)

(Av. mol. wt: 900)

(130)

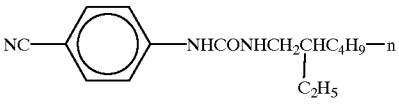

(131)

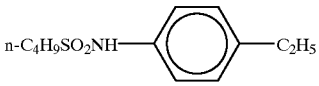

(132)

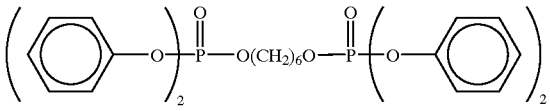

When the silver halide photographic lightsensitive material of the present invention is used in a color lightsensitive material, it is only required that at least one lightsensitive layer be formed on a support. A typical example thereof is a silver halide photographic lightsensitive material having, on its support, at least one lightsensitive layer constituted by a plurality of silver halide emulsion layers which have substantially the same color sensitivity but have different light sensitivities. This lightsensitive layer includes a unit lightsensitive layer which is sensitive to any of blue light, green light and red light. In a multilayered silver halide color photographic lightsensitive material, these unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045, the disclosures of which are herein incorporated by reference. Also, as described in JP-A's-57-112751, 62-200350, 62-206541 and 62-206543, the disclosures of which are herein incorporated by reference, layers can be arranged so that a low-speed emulsion layer is formed on a side apart from a support while a high-speed emulsion layer is formed on a side closer to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in Jpn. Pat. Appln. KOKOKU Publication No. (hereinafter referred to as JP-B-) 55-34932, the disclosure of which is herein incorporated by reference, layers can be arranged, from the farthest side from a support, in the order of blue-sensitive layer/GH/RH/GL/RL. Furthermore, as described in JP-A-56-25738 and JP-A-62-63936, the disclosures of which are herein incorporated by reference, layers can be arranged, from the farthest side from a support, in the order of blue-sensitive layer/GL/RL/GH/RH.

As described in JP-B-49-15495, the disclosure of which is herein incorporated by reference, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464, the disclosure of which is herein incorporated by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in U.S. Pat. Nos. 4,663,271, 4,705,744, 4,707,436, JP-A-62-160448 and JP-A-63-89850, the disclosures of which are herein incorporated by reference, is preferably arranged adjacent to or close to the main lightsensitive layers.

A preferable silver halide used in the present invention is silver iodobromide, silver iodochloride or silver iodochlorobromide containing about 30 mol % or less of silver iodide. A particularly preferable silver halide is silver iodobromide or silver iodochlorobromide containing about 2 mol % to about 10 mol % of silver iodide.

Silver halide grains contained in the photographic emulsion used in the photographic material of the invention may those having regular crystals such as cubic, octahedral or tetradecahedral crystals, having irregular crystals such as spherical or tabular crystals or having crystal defects such as at least one twin face, or composite forms thereof.

With respect to the grain diameter, the silver halide can consist of fine grains having a grain size of about 0.2 $\mu$m or less or large grains having a projected area diameter of up to about 10 $\mu$m, and the emulsion may be either a polydisperse or monodisperse emulsion.

The silver halide photographic emulsion which can be used in the present invention can be prepared by methods described in, e.g., "I. Emulsion preparation and types," Research Disclosure (to be abbreviated as RD hereafter) No. 17643 (December, 1978), pp. 22 and 23, "I. Emulsion preparation and types"; and RD No. 18716 (November, 1979), page 648; RD No. 307105 (November, 1989), pp. 863 to 865; P. Glafkides, "Chemie et Phisique Photographiques", Paul Montel, 1967; G. F. Duffin, "Photographic Emulsion Chemistry", Focal Press, 1966; and V. L. Zelikman et al., "Making and Coating Photographic Emulsion", Focal Press, 1964, all the disclosures of which are herein incorporated by reference.

Monodisperse emulsions described in, for example, U.S. Pat. Nos. 3,574,628, and 3,655,394 and GB No. 1,413,748 are also preferable, the disclosures of which are herein incorporated by reference.

Also, tabular grains having an aspect ratio of about 3 or more can be used in the present invention. Tabular grains can be easily prepared by methods described in, e.g., Gutoff, "Photographic Science and Engineering", Vol. 14, pp. 248 to 257 (1970), U.S. Pat. Nos. 4,434,226, 4,414,310, 4,433,048, and 4,439,520, and GB No. 2,112,157, the disclosures of which are herein incorporated by reference.

The crystal structure can be uniform, can have halogen compositions which are different between the inner part and the outer part thereof, or can be a layered structure. Alternatively, the silver halide can be bonded with a silver halide having a different composition by an epitaxial junction, for example, can be bonded with a compound other than silver halide such as silver rhodanide or lead oxide. A mixture of grains having various crystal forms can also be used.

The above emulsion can be any of a surface latent image type emulsion which mainly forms a latent image on the surface of a grain, an internal latent image type emulsion which forms a latent image in the interior of a grain and an emulsion of another type which has latent images on the surface and in the interior of a grain. However, the emulsion must be a negative type emulsion. The internal latent image type emulsion can be a core/shell internal latent image type emulsion described in JP-A-63-264740, the disclosure of which is herein incorporated by reference. The method of preparing this core/shell internal latent image type emulsion is described in JP-A-59-133542, the disclosure of which is herein incorporated by reference. Although the thickness of a shell of this emulsion depends on, e.g., development conditions, it is preferably 3 to 40 nm, more preferably 5 to 20 nm.

The silver halide emulsion is generally subjected to physical ripening, chemical ripening and spectral sensitization before use. Additives used in these steps are listed in RD Nos. 17643, 18716 and 307105, the disclosures of which are herein incorporated by reference and relevant portions of which are summarized in a below given table.

In the lightsensitive material of the present invention, two or more lightsensitive silver halide emulsions which are different from each other in at least one property among the grain size, grain size distribution, halogen composition, grain morphology and sensitivity thereof can be mixed together and used in a single layer.

Silver halide grains having their surface fogged as described in U.S. Pat. No. 4,082,553, silver halide grains having their internal part fogged as described in U.S. Pat. No. 4,626,498 and JP-A-59-214852 and colloidal silver are preferably used in the lightsensitive silver halide emulsion layer and/or substantially nonlightsensitive hydrophilic colloid layer, all the disclosures of which are herein incorporated by reference. The silver halide grains having their internal part or surface fogged refers to the silver halide grains which can be developed uniformly (in nonimagewise manner), irrespective of the exposed or unexposed part of the lightsensitive material. The process for producing the same is described in U.S. Pat. No. 4,626,498 and JP-A-59-214852, the disclosures of which are herein incorporated by reference. Silver halides forming the internal nuclei of core/shell type silver halide grains having their internal part fogged may have different halogen compositions. The silver halide having its grain internal part or surface fogged can be any of silver chloride, silver chlorobromide, silver iodobromide and silver chloroiodobromide. The average grain size of these fogged silver halide grains is preferably 0.01 to 0.75 $\mu$m, more preferably 0.05 to 0.6 $\mu$m. With respect to grain morphology, use can be made of regular grains and a polydispersed emulsion indiscriminately. However, a monodispersed emulsion, i.e., at least 95% of the total weight or whole number of grains of the silver halide grains have a grain size which falls within ±40% of the average grain size, is preferred.

In the present invention, it is preferable to use a nonlightsensitive fine grain silver halide. The nonlightsensitive fine grain silver halide preferably consists of silver halide fine grains which are not sensitive during imagewise exposure for obtaining a dye image and are substantially not developed during a development step. These silver halide grains are preferably not fogged in advance. In the fine grain silver halide, the content of silver bromide is 0 to 100 mol %, and silver chloride and/or silver iodide can be contained if necessary. The fine grain silver halide preferably contains 0.5 to 10 mol % of silver iodide. The average grain size, i.e., the average value of equivalent circle diameters of projected areas, of the fine grain silver halide is preferably 0.01 to 0.5 $\mu$m, more preferably 0.02 to 0.2 $\mu$m.

The fine grain silver halide can be prepared in the same manner as that of common lightsensitive silver halide. The surface of silver halide grains need not be optically sensitized nor spectrally sensitized. However, before the addition of silver halide grains to a coating solution, it is preferable to add thereto a generally known stabilizer such as a triazole compound, an azaindene compound, a benzothiazolium compound, a mercapto compound, or a zinc compound.

Colloidal silver can be incorporated in this fine grain silver halide containing layer.

The silver coating amount of the lightsensitive material of the present invention is preferably 6.0 g/m$^2$ or less, most preferably 4.5 g/m$^2$ or less.

Photographic additives usable in the present invention are also described in RD's, and the relevant description portions are summarized in the following table.

| Types of additives | RD17643 | RD18716 | RD307105 |
|---|---|---|---|
| 1. Chemical sensitizers | page 23 | page 648 right column | page 866 |
| 2. Sensitivity increasing agents | | page 648 right column | |
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surfactants | pages 26–27 | page 650, right column | pages 875–876 |
| 9. Antistatic agents | page 27 | page 650, right column | pages 876–877 |
| 10. Matting agents | | | pages 878–879 |

Various dye forming couplers can be used in the light-sensitive material of the present invention, and the following couplers are particularly preferable.

Yellow couplers: couplers represented by formulas (I) and (II) in EP No. 502,424A; couplers represented by formulas (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulas (II) to (IV) in column 7, lines 36 to 58, in U.S. Pat. No. B4,476,219 (particularly II-17, II-19 (column 17), and II-24 (column 19)), all the disclosures of which are herein incorporated by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP No. 456,257; M-4 and M-6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, all the disclosures of which are herein incorporated by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, all the disclosures of which are herein incorporated by reference.

Polymer couplers: P-1 and P-5 (page 11) in JP-A-2-44345, the disclosure of which is herein incorporated by reference.

Couplers for forming a colored dye with a proper diffusibility are preferably those described in U.S. Pat. No. 4,366,237, GB No. 2,125,570, EP No. 96,873B, and DE No. 3,234,533, all the disclosures of which are herein incorporated by reference.

Couplers for correcting the unnecessary absorption of a colored dye are preferably yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), all the disclosures of which are herein incorporated by reference.

Examples of compounds (including a coupler) which react with a developing agent in an oxidized for to thereby release a photographically useful compound residue are as follows and all the disclosures of the documents are herein incorporated by reference. Development inhibitor release compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator release compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2), and (3) in column 3 of U.S. Pat. No. 4,656,123 (particularly (I-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows and all the disclosures of the following documents are herein incorporated by reference.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199, 363. Developing agent oxidation product scavengers: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color amalgamation inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520, 938A; and compounds (1) to (31) (columns 2 to 9) represented by formula (1) in EP No. 521,823A.

The photographic material of the present invention can be applied to various color lightsensitive materials such as color negative films for general purposes or cinemas, color reversal films for slides and TV, color paper, color positive films and color reversal paper. Moreover, the photographic material of the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the lightsensitive material of the present invention, the total of film thicknesses of all hydrophilic colloid layers on the side having emulsion layers is preferably 28 μm or less, more preferably 23 μm or less, still more preferably 18 μm or less, and most preferably 16 μm or less. Film swell speed $T_{1/2}$ is preferably 30 sec or less, more preferably 20 sec or less. The film swell speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swell speed $T_{1/2}$ can be measured by using a swellometer described in A. Green et al., Photogr. Sci. Eng., Vol. 19, No. 2, pp. 124 to 129. The film swell speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

(maximum swollen film thickness−film thickness)/film thickness.

In the lightsensitive material of the present invention, hydrophilic colloid layers (called "back layers") having a total dried film thickness of 2 to 20 μm are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The lightsensitive material according to the present invention can be developed by conventional methods described in above mentioned RD. No. 17643, pp. 28 and 29; RD. No. 18716, page 651, left to right columns; and RD No. 307105, pp. 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are, for example, 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol, per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents such as alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di (sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonic salts, phosphoric salts, sulfosalicylic salts and boric salts are used for stabilizing the above pH value.

Although the amount of the replenisher of the color developing solution preferably ranges from 80 to 1300 milliliters (hereinafter also referred to as "mL") per $m^2$ of the lightsensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

Wherein

C: bromide ion concentration of the color developing replenisher (mol/L),

A: target bromide ion concentration of the color developing solution (mol/L),

W: amount of bromide ion leached from the lightsensitive material into the color developing solution when a color development of 1 $m^2$ of the lightsensitive material has been carried out (mol), and V: amount of color developing replenisher supplied per $m^2$ of the lightsensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A's-5-72694 and 5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A-4-251845, JP-A-4-268552, EP No. 588,289, EP No. 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$CR=CT\times(V1+V2)/V1+CP$$

wherein

CR: concentration of each component in the replenisher,

CT: concentration of the component in the mother liquor (processing tank solution), CP: component concentration consumed during processing, V1: amount of replenisher having bleaching capability supplied per $m^2$ of lightsensitive material (mL), and V2: amount carried from previous bath by 1 $m^2$ of lightsensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL, of a bleaching replenisher per $m^2$ of the lightsensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL, per $m^2$ of the lightsensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the lightsensitive material.

The replenishing amount of water washing and stabilizing solutions is preferably in the range of 80 to 1000 mL, more preferably 100 to 500 mL, and most preferably 150 to 300 mL, per $m^2$ of the lightsensitive material from the viewpoint that water washing and stabilizing functions are ensured and that the amount of waste solution is reduced to contribute to environment protection. In the processing with the above replenishing amount, known mildewproofing agents such as thiabenzazole, 1,2-benzoisothiazolin-3-one and 5-chloro-2-methylisothiazolin-3-one, antibiotics such as gentamicin and water deionized by the use of, for example, an ion exchange resin are preferably used for preventing the breeding of bacteria and mildew. The use of deionized water, a mildewproofing agent and an antibiotic in combination is more effective than individual uses.

With respect to the solution placed in the water washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably harvested from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent used for the photographic material of the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A's-51-61837 and 6-102628 and a paste processing agent in PCT National Publication 57-500485. Although any of these can be suitably used, from the viewpoint of easiness in use, it is preferred to employ a liquid prepared in the same concentration as in use in advance.

The container for storing the above processing agent is composed of, for example, any one or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 $\mu$m so that the oxygen permeability therethrough is 20 $mL/m^2 \cdot 24$ hrs·atm or less.

The processing solution for the color reversal film to which the present invention is applicable will be described below.

With respect to the processing of color reversal films, detailed descriptions are made in Public Technology No. 6 (Apr. 1, 1991) issued by Aztek, page 1, line 5 to page 10, line 5 and page 15, line 8 to page 24, line 2, any of which can be preferably applied thereto. In the color reversal film processing, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment. Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

The color photographic lightsensitive material to which the present invention has been applied is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Uturundesu Super Slim produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) rear touching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is preferably Fuji Film Minilao Champion Super FA-298/FA-278/FA-258/FA-238 or Fuji Film Digital Labo System Frontier. Film processor of the Minilabo Champion is, for example, FP922AL/FP562B/FP562B, AL/FP362B/FP3622B, AL, and recommended processing chemical is Fuji Color Just It CN-16L or CN-16Q. Printer processor is, for example, PP3008AR/PP3008A/PP1828AR/PP1828A/PP1258AR/PP1258A/PP728AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

The magnetic recording layer for use in the present invention will be described below.

The magnetic recording layer is obtained by coating a support with a water-base or organic solvent coating liquid having magnetic material grains dispersed in a binder.

Suitable magnetic material grains can be composed of any of ferromagnetic iron oxides such as $\gamma$ $Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of SBET. The saturation magnetization ($\sigma s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259, and 5,215,874 and EP No. 466,130.

The polyester support for use in the present invention will be described below. Particulars thereof together with the below mentioned lightsensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The subbing method will be described below. The substratum may be composed of either a single layer or at least two layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, SiO2, TiO2, inorganic fine grains or polymethyl methacrylate copolymer fine grains (0.01 to 10 μm) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 μm or a composite oxide thereof (Sb, P, B, In, S, Si, C, etc.) and fine grains of sol form metal oxides or composite oxides thereof. The content thereof in the lightsensitive material is preferably in the range of 5 to 500 $mg/m^2$, more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the lightsensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 $\mu$m. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 $\mu$m or less be simultaneously added, which include, for example, fine grains of polymethyl methacrylate (0.2 $\mu$m), poly(methyl methacrylate/methacrylic acid) (9/1 in molar ratio, 0.3 $\mu$m), polystyrene (0.25 $\mu$m) and colloidal silica (0.03 $\mu$m).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A-1-312537 and JP-A-1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 cm$^3$ or less, more preferably 25 cm$^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

With respect to the various additives and development processing which are useful when the present invention is applied to black and white lightsensitive materials, there is no particular limitation. Examples of the black and white material include a black and white negative film, a black and white photographic paper, a film for lithography, i.e., a lithographic film, and a X-ray film. Also, a monochrome light-sensitive material in which a coupler is used, can be mentioned as an example. For example, those described in the following listed portions of JP-A's-2-68539, 5-11389 and 2-58041, the disclosures of which are herein incorporated by reference, can preferably be employed.

1. Silver halide emulsion and process for producing the same: JP-A-2-68539, from page 8, right lower column, line 6 from last to page 10, right upper column, line 12;

2. Method of chemical sensitization: JP-A-2-68539, from page 10, right upper column, line 13 to page 10, left lower column, line 16; method of selenium sensitization described in JP-A-5-11389;

3. Antifoggant and stabilizer: JP-A-2-68539, from page 10, left lower column, line 17 to page 11, left upper column, line 7 and from page 3, left lower column, line 2 to page 4, left lower column;

4. Spectral sensitizing dye: JP-A-2-68539, from page 4, right lower column, line 4 to page 8, right lower column and JP-A-2-58041, from page 12, left lower column, line 8 to page 12, right lower column, line 19.

5. Surfactant and antistatic agent: JP-A-2-68539, from page 11, left upper column, line 14 to page 12, left upper column, line 9 and JP-A-2-58041, from page 2, left lower column, line 14 to page 5, line 12;

6. Matting agent, plasticizer and sliding agent: JP-A-2-58041, from page 12, left upper column, line 10 to page 12, right upper column, line 10 and JP-A-2-58041, from page 5, left lower column, line 13 to page 10, left lower column, line 3;

7. Hydrophilic colloid: JP-A-2-68539, from page 12, right upper column, line 11 to page 12, left lower column, line 16;

8. Hardener: JP-A-2-68539, from page 12, left lower column, line 17 to page 13, right upper column, line 6; and 9. Method of development processing: JP-A-2-68539, from page 15, left upper column, line 14 to page 15, left lower column, line 13.

Furthermore, the silver halide lightsensitive material of the present invention can also be applied to the preparation of heat development type lightsensitive material as described in, for example, U.S. Pat. No. 4,500,626, JP-A's-60-133449, 59-218443, and 61-238056 and EP No. 210, 660A2.

EXAMPLES

The present invention will be described in greater detail below by way of its examples, which in no way limit the scope of the present invention.

Example 1

A support as employed in Example 3 set forth below was coated with a plurality of layers of the following compositions, thereby preparing monochrome lightsensitive material sample 101. The figure given beside the description of each component is for the coating amount expressed in the unit of g/m$^2$. With respect to a silver halide, the coating amount is in terms of silver. Regarding the sensitizing dye, however, the coating amount is expressed in the unit of mol per mol of silver halide present in the same layer.

The materials and emulsions used in the individual layers will be described in Example 3.

| (Sample 101) | |
|---|---|
| 1st layer (green-sensitive silver halide emulsion layer) | |
| Silver iodobromide emulsion E | silver 0.16 |
| Silver iodobromide emulsion F | silver 0.19 |
| Silver iodobromide emulsion G | silver 0.20 |
| ExS-4 | $2.3 \times 10^{-5}$ |
| ExS-5 | $8.0 \times 10^{-5}$ |
| ExS-6 | $3.7 \times 10^{-4}$ |
| ExS-7 | $7.4 \times 10^{-5}$ |
| ExS-8 | $3.3 \times 10^{-4}$ |
| ExM-3 | 0.385 |
| HBS-1 | 0.393 |
| HBS-3 | 0.016 |
| Gelatin | 1.039 |
| 2nd layer (interlayer) | |
| Gelatin | 2.000 |
| 3rd layer (yellow color layer) | |
| ExY-2 | 1.000 |
| HBS-1 | 0.333 |
| Gelatin | 2.409 |
| 4th layer (protective layer) | |
| H-1 | 0.18 |
| B-1 (diameter 1.7 μm) | 0.05 |
| B-2 (diameter 1.7 μm) | 0.12 |
| B-3 | 0.15 |
| ES-1 | 0.25 |
| Gelatin | 2.14 |
| (Preparation of Samples 102 to 115) | |

Samples 102 to 115 were prepared in the same manner as in the preparation of Sample 101, except that the high-boiling-point organic solvent HBS-1 contained in the first layer of Sample 101 was replaced by the same weight of each of the compounds 1, 2, 3, 6, 12 and 19 (hereinafter also referred to as "high-boiling-point organic solvents of the present invention") that are within the scope of the general formula (1) of the present invention and comparative high-boiling-point organic solvents (a) to (h) described later in Example 3.

In recent years, lens-equipped film units represented by "Utsurundesul" (Quick Snap) have explosively spread, magnificently enlarging the field of photography. The lens-equipped film units are small and inexpensive as compared with common cameras, so that they are often roughly handled. One of the unexpected troubles having been caused by the rough handling is a collapse of gradation balance which occurs when the lens-equipped film units are exposed to ultrahigh humidity conditions. This invites a divergence of print color tone and thus invites an extreme deterioration of finish quality. Therefore, countermeasures are strongly demanded.

This trouble would occur when the lens-equipped film unit is placed in an inner pocket in which the temperature and humidity are likely to rise for a prolonged period of time, or when the lens-equipped film unit is placed together with wet clothes in a bag, or when the lens-equipped film unit per se is directly wetted.

Investigation has been conducted for ultrahigh humidity conditions which can reproduce actual trouble. As a result, it has been found that a relative humidity of 100% at 40° C. meets the above conditions.

(Test on Photographic Performance Change Under Ultrahigh Humidity Conditions)

With respect to each of the Samples 101 to 115, two sets of films were prepared, and one set was stored in a relative humidity of 65% at 40° C. for 16 hr (storage condition A: comparative standard humidity condition) while the other set was stored in a relative humidity of 100% at 40° C. for 16 hr (storage condition B).

The resultant individual sample films were subjected to wedge exposure conducted with the use of white light and thereafter to development processing as described in Example 3 set forth below, except that the color development processing time was changed to 2 min 45 sec. Sensitometry of the processed samples was performed to thereby determine the maximum color density (Dmax) and the ratio of maximum color density (storage condition B vs. storage condition A).

The results are specified in Table 1.

TABLE 1

| Sample No. | Solvent* | Dmax (A) | Dmax (B) | Dmax(B)/ Dmax(A) |
|---|---|---|---|---|
| 101 | HBS-1 | 1.90 | 1.36 | 0.72 |
| 102 (Inv) | 1 | 1.89 | 1.86 | 0.98 |
| 103 (Inv) | 2 | 1.90 | 1.91 | 1.01 |
| 104 (Inv) | 3 | 1.88 | 1.87 | 0.99 |
| 105 (Inv) | 6 | 1.88 | 1.87 | 0.99 |
| 106 (Inv) | 12 | 1.93 | 1.90 | 0.99 |
| 107 (Inv) | 19 | 1.86 | 1.87 | 1.01 |
| 108 | a | 1.22 | 0.97 | 0.80 |
| 109 | b | 1.62 | 1.61 | 0.99 |
| 110 | c | 1.35 | 1.27 | 0.94 |
| 111 | d | 1.98 | 1.19 | 0.60 |
| 112 | e | 1.51 | 1.53 | 1.01 |
| 113 | f | 1.81 | 1.54 | 0.85 |
| 114 | g | 0.72 | 0.70 | 0.97 |
| 115 | h | 0.66 | 0.67 | 1.02 |

*High-boiling-point organic solvent

It is apparent from Table 1 that, with respect to each of the samples using the high-boiling-point organic solvent of the present invention, the color density under the storage condition A is high and there is little density decrease under the storage condition B. The reason for the decrease of color density by the storage under the ultrahigh humidity condition would be that the color reactivity of magenta coupler is lowered by a decrease of the amount of high-boiling-point organic solvent contained in the green-sensitive silver halide emulsion layer, which decrease is attributed to the diffusion of the high-boiling-point organic solvent contained in the green-sensitive silver halide emulsion layer into another layer, herein the blue-sensitive silver halide emulsion layer. The decrease of color density by the storage under the ultrahigh humidity condition can be relieved by replacing HBS-1 (tricresyl phosphate) with a more hydrophobic high-boiling-point organic solvent (e), (g) or (h). However, this invites a marked decrease of color density under the standard condition (storage condition A). Thus, only the use of the bis type aryl phosphoric acid ester high-boiling-point organic solvent of the present invention enables reconciling the color performance under the standard condition and the color performance after the storage under the ultrahigh humidity condition.

Example 2

A support as employed in Example 3 set forth below was coated with a plurality of layers of the following compositions, thereby preparing monochrome lightsensitive material sample 201. The figure given beside the description of each component is for the coating amount expressed in the unit of g/m$^2$. With respect to a silver halide, the coating amount is in terms of silver. Regarding the sensitizing dye, however, the coating amount is expressed in the unit of mol per mol of silver halide present in the same layer.

The materials and emulsions used in the individual layers will be described in Example 3 below.

| (Sample 201) | |
|---|---|
| 1st layer (magenta color layer) | |
| ExM-3 | 0.385 |
| HBS-1 | 0.393 |
| HBS-3 | 0.016 |
| Gelatin | 1.039 |
| 2nd layer (interlayer) | |
| Gelatin | 2.000 |
| 3rd layer (blue-sensitive silver halide emulsion layer) | |
| Silver iodobromide emulsion J | silver 0.18 |
| Silver iodobromide emulsion K | silver 0.08 |
| Silver iodobromide emulsion L | silver 0.36 |
| ExS-9 | $8.4 \times 10^{-4}$ |
| ExY-2 | 1.000 |
| HBS-1 | 0.333 |
| Gelatin | 2.409 |
| 4th layer (protective layer) | |
| H-1 | 0.18 |
| B-1 (diameter 1.7 μm) | 0.05 |
| B-2 (diameter 1.7 μm) | 0.12 |
| B-3 | 0.15 |
| ES-1 | 0.25 |
| Gelatin | 2.14 |

(Preparation of Samples 202 to 216)

Samples 202 to 215 were prepared in the same manner as in the preparation of Sample 201, except that the high-boiling-point organic solvent HBS-1 contained in the first layer of Sample 201 was replaced by the same weight of each of the high-boiling-point organic solvents 1, 2, 3, 6, 12 and 19 of the present invention and comparative high-boiling-point organic solvents (a) to (h) described later. Further, Sample 216 was prepared in the same manner as in the preparation of Sample 201, except that the magenta coupler ExM-3 and the high-boiling-point organic solvents HBS-1 and HBS-3 were removed from the first layer of Sample 201.

(Test on Photographic Performance Change Under Ultrahigh Humidity Conditions)

With respect to each of the Samples 201 to 216, two sets of films were prepared, and one set was stored in a relative humidity of 65% at 40° C. for 16 hr (storage condition A: comparative standard humidity condition) while the other set was stored in a relative humidity of 100% at 40° C. for 16 hr (storage condition B).

The resultant individual sample films were subjected to wedge exposure conducted with the use of white light and thereafter to development processing as described below in Example 3, provided that the color development processing time was changed to 2 min 45 sec. Sensitometry of the processed samples was performed to thereby determine the gradation gradient at an exposure realizing a color density equal to ½ of the maximum color density, namely "gamma", with respect to each of the storage conditions A and B. The results are specified in Table 2.

TABLE 2

| Sample No. | Solvent* | Gamma | Gamma |
|---|---|---|---|
| 201 (Comp) | HBS-1 | 0.78 | 0.84 |
| 202 (Inv) | 1 | 0.77 | 0.77 |
| 203 (Inv) | 2 | 0.77 | 0.78 |
| 204 (Inv) | 3 | 0.77 | 0.77 |
| 205 (Inv) | 6 | 0.78 | 0.79 |
| 206 (Inv) | 12 | 0.76 | 0.77 |
| 207 (Inv) | 19 | 0.77 | 0.77 |
| 208 (Comp) | a | 0.79 | 0.84 |
| 209 (Comp) | b | 0.78 | 0.78 |
| 210 (Comp) | c | 0.80 | 0.85 |
| 211 (Comp) | d | 0.79 | 0.85 |
| 212 (Comp) | e | 0.77 | 0.78 |
| 213 (Comp) | f | 0.78 | 0.82 |
| 214 (Comp) | g | 0.76 | 0.77 |
| 215 (Comp) | h | 0.77 | 0.77 |
| 216 (Comp) | none | 0.77 | 0.77 |

*High-boiling-point organic solvent

It is apparent from Table 2 above that almost no change occurs in the gamma even when the samples of the present invention are stored in ultrahigh humidity (storage condition B). With respect to the sample using the high-boiling-point organic solvent HBS-1, (a), (c) or (d), the gamma of the blue-sensitive silver halide emulsion layer is increased by the storage thereof under ultrahigh humidity conditions. Taking the results of Sample 216 into account, it can be considered that the gamma increase is caused by the diffusion of the high-boiling-point organic solvent contained in the green-sensitive silver halide emulsion layer into the blue-sensitive silver halide emulsion layer, which diffusion accelerates the color reaction of the yellow coupler ExY-2.

It can be stated from these in combination with the results of Example 1 that the lightsensitive materials in which the high-boiling-point organic solvent of the present invention is employed suppress the change of photographic performance of not only the layer in which the high-boiling-point organic solvent of the invention is contained itself but also other layers even when exposed to ultrahigh humidity conditions.

Example 3

1) Support

The support employed in this Example was prepared by the following method.

100 parts by weight of polyethylene 2,6-naphthalate polymer and 2 parts by weight of Tinuvin P.326 (produced by Ciba-Geigy) as an ultraviolet absorber were dried, melted at 300° C., extruded through a T die, longitudinally oriented at 140° C. to a 3.3-fold length, laterally oriented at 130° C. to a 3.3-fold width and thermally set at 250° C. for 6 sec. Thus, a PEN film having a thickness of 90 μm was obtained. Appropriate amounts of blue dye, magenta dye and yellow dye (I-1, I-4, I-6, I-24, I-26, I-27 and II-5 described in JIII Journal of Technical Disclosure No. 94-6023) were mixed in this PEN film. Further, this PEN film was wound round a stainless steel core with a diameter of 20 cm, and a 110° C./48 hr heat history was imparted thereto. Thus, a support with a low tendency to curl was obtained.

2) Application of Subbing Layer by Coating

Both sides of the above support were treated by corona discharge, UV irradiation and glow discharge. Thereafter, a subbing liquid consisting of 0.1 g/m$^2$ of gelatin, 0.01 g/m$^2$ of sodium α-sulfo-di-2-ethylhexyl succinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of polyamide/epichlorohydrin polycondensate was applied onto one of the sides (10 mL/m$^2$ by the use of a bar coater) so that a subbing layer was provided on a side exposed to high temperature at the time of orientation. Drying was conducted at 115° C. for 6 min (all of the rollers and conveyor of drying zone were heated at 115° C.).

3) Application of Back Layer by Coating

After the subbing, an antistatic layer, a magnetic recording layer and a slide layer of the following respective compositions as back layers were applied by coating to the other side of the support.

3-1) Application of Antistatic Layer by Coating

Coating was made with 0.2 g/m$^2$ of a dispersion of fine grain powder with a resistivity of 5 Ω·cm (secondary aggregate grain diameter: approximately 0.08 μm) composed of a tin oxide/antimony oxide composite having an average particle size of 0.005 μm, 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10) and 0.22 g/m$^2$ of resorcinol.

3-2) Application of Magnetic Recording Layer by Coating

A magnetic recording layer having a thickness of 1.2 μm was obtained by applying, by means of a bar coater, 0.06 g/m$^2$ of cobalt/γ-iron oxide (specific surface area: 43 m$^2$/g, major axis: 0.14 μm, minor axis: 0.03 μm, saturation magnetization: 89 emu/g, $Fe^{2+}/Fe^{3+}$=6/94, surface treated with aluminum oxide/silicon oxide in an amount of 2% by weight based on iron oxide) coated with 3-polyoxyethylene-propyloxytrimethoxysilane (polymerization degree: 15; 15% by weight), 1.2 g/m$^2$ of diacetylcellulose (iron oxide dispersed by the use of an open kneader and a sand mill) and 0.3 g/m$^2$ of $C_2H_5C(CH_2OCONH{-}C_6H_3(CH_3)NCO)_3$ as a hardener together with acetone, methyl ethyl ketone and cyclohexanone as a solvent. As a matting agent, silica particles (0.3 μm) and abrasive aluminum oxide (0.15 μm) coated with 3-polyoxyethylene-propyloxytrimethoxysilane (polymerization degree 15; 15% by weight) were each added in an amount of 10 mg/m$^2$. Drying was conducted at 115° C. for 6 min (all of the rollers and conveyor of drying zone were heated at 115° C.). With respect to the obtained magnetic recording layer, the $D^B$ color density increment with X-lite (blue filter), saturation magnetization moment, coercive force and rectangular ratio were approximately 0.1, 4.2 emu/g, 7.3×10$^4$ A/m and 65%, respectively.

3-3) Preparation of Slide Layer

Coating was made with a mixture of diacetylcellulose (25 mg/m$^2$) and $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). This mixture was prepared by melting in xylene/propylene glycol monomethyl ether (1/1) at 105° C. and pouring and dispersing in propylene glycol monomethyl ether (10-fold amount) at ordinary temperature and formed into a dispersion (average particle size: 0.01 μm) in acetone before addition. As a matting agent, silica particles (0.3 μm) and abrasive aluminum oxide (0.15 μm) coated with 3-polyoxyethylene-propyloxytrimethoxysilane (polymerization degree 15; 15% by weight) were each added in an amount of 15 mg/m$^2$. Drying was conducted at 115° C. for 6 min (all of the rollers and conveyor of drying zone were heated at 115° C.). With respect to the obtained slide layer, the kinematic friction coefficient (stainless steel hard ball with a diameter of 5 mm, load: 100 g, speed: 6 cm/min), static friction coefficient (clip method) and kinematic friction coefficient between emulsion face and slide layer as described later were 0.06, 0.07 and 0.12, respectively, ensuring excellent performance.

4) Application of Lightsensitive Layer by Coating

The side opposite to back layers of the thus obtained support was coated with a plurality of layers of the following respective compositions, thereby obtaining a color negative film, designated Sample 301.

(Composition of Lightsensitive Layer)

Main materials used in each layer are classified as follows:

ExC: cyan coupler, UV: ultraviolet absorber,

ExM: magenta coupler, HBS: high b.p. org. solvent,

ExY: yellow coupler, H: gelatin hardener, and

ExS: sensitizing dye

The numeric value given beside the description of each component is for the coating amount expressed in the unit of g/m$^2$. With respect to the silver halide, the coating amount is in terms of silver quantity. Regarding the sensitizing dye, however, the coating amount is expressed in the unit of mol per mol of silver halide present in the same layer.

(Sample 301)

| | |
|---|---|
| 1st layer (first antihalation layer) | |
| Black colloidal silver | silver 0.14 |
| Gelatin | 0.50 |
| 2nd layer (second antihalation layer) | |
| Black colloidal silver | silver 0.12 |
| Gelatin | 0.57 |
| ExM-1 | 0.12 |
| ExF-1 | 2.0 × 10$^{-3}$ |
| Solid disperse dye ExF-2 | 0.030 |
| Solid disperse dye ExF-3 | 0.040 |
| HBS-1 | 0.15 |
| HBS-2 | 0.02 |
| 3rd layer (Interlayer) | |
| Silver iodobromide emulsion N | silver 0.06 |
| ExC-2 | 0.05 |
| Polyethyl acrylate latex | 0.20 |
| Gelatin | 0.70 |
| 4th layer (Low-speed red-sensitive emulsion layer) | |
| Silver iodobromide emulsion A | silver 0.27 |
| Silver iodobromide emulsion B | silver 0.12 |
| ExS-1 | 5.8 × 10$^{-4}$ |
| ExS-2 | 0.8 × 10$^{-5}$ |
| ExS-3 | 2.5 × 10$^{-4}$ |
| ExC-1 | 0.28 |
| ExC-3 | 0.058 |
| ExC-4 | 0.19 |
| ExC-5 | 0.03 |
| ExC-6 | 0.02 |
| Cpd-2 | 0.025 |
| HBS-1 | 0.28 |
| Gelatin | 2.00 |
| 5th layer (Medium-speed red-sensitive emulsion layer) | |
| Silver iodobromide emulsion B | silver 0.77 |
| ExS-1 | 6.5 × 10$^{-4}$ |
| ExS-2 | 0.9 × 10$^{-5}$ |
| ExS-3 | 2.8 × 10$^{-4}$ |
| ExC-1 | 0.12 |
| ExC-2 | 0.04 |
| ExC-3 | 0.055 |
| ExC-4 | 0.08 |
| ExC-5 | 0.02 |
| ExC-6 | 0.015 |
| Cpd-4 | 0.024 |
| Cpd-2 | 0.025 |

-continued (Sample 301)

| | | |
|---|---|---|
| HBS-1 | | 0.10 |
| Gelatin | | 0.92 |
| 6th layer (High-speed red-sensitive emulsion layer) | | |
| Silver iodobromide emulsion C | silver | 0.93 |
| ExS-1 | | $5.8 \times 10^{-4}$ |
| ExS-2 | | $0.8 \times 10^{-5}$ |
| ExS-3 | | $2.8 \times 10^{-4}$ |
| ExC-1 | | 0.044 |
| ExC-3 | | 0.022 |
| ExC-6 | | 0.012 |
| ExC-7 | | 0.010 |
| Cpd-2 | | 0.065 |
| Cpd-4 | | 0.065 |
| HBS-1 | | 0.16 |
| HBS-2 | | 0.080 |
| Gelatin | | 1.10 |
| 7th layer (Interlayer) | | |
| Cpd-1 | | 0.060 |
| Solid disperse dye ExF-4 | | 0.030 |
| HBS-1 | | 0.043 |
| Polyethyl acrylate latex | | 0.19 |
| Gelatin | | 1.05 |
| 8th layer (Low-speed green-sensitive emulsion layer) | | |
| Silver iodobromide emulsion E | silver | 0.18 |
| Silver iodobromide emulsion F | silver | 0.21 |
| Silver iodobromide emulsion G | silver | 0.22 |
| ExS-7 | | $8.1 \times 10^{-5}$ |
| ExS-8 | | $3.6 \times 10^{-4}$ |
| ExS-4 | | $2.5 \times 10^{-5}$ |
| ExS-5 | | $8.8 \times 10^{-5}$ |
| ExS-6 | | $4.1 \times 10^{-4}$ |
| ExM-3 | | 0.20 |
| ExM-4 | | 0.06 |
| ExY-1 | | 0.01 |
| ExY-5 | | 0.0020 |
| HBS-1 | | 0.18 |
| HBS-3 | | 0.008 |
| Cpd-4 | | 0.010 |
| Gelatin | | 0.73 |
| 9th layer (Medium-speed green-sensitive emulsion layer) | | |
| Silver iodobromide emulsion G | silver | 0.47 |
| Silver iodobromide emulsion H | silver | 0.35 |
| ExS-4 | | $3.9 \times 10^{-5}$ |
| ExS-7 | | $2.0 \times 10^{-4}$ |
| ExS-8 | | $8.9 \times 10^{-4}$ |
| ExC-8 | | 0.0020 |
| ExM-3 | | 0.18 |
| ExM-4 | | 0.055 |
| ExC-6 | | 0.016 |
| ExY-4 | | 0.001 |
| ExY-5 | | 0.001 |
| Cpd-4 | | 0.015 |
| HBS-1 | | 0.18 |
| HBS-3 | | 0.009 |
| Gelatin | | 1.00 |
| 10th layer (High-speed green-sensitive emulsion layer) | | |
| Silver iodobromide emuision I | silver | 0.95 |
| ExS-4 | | $6.2 \times 10^{-5}$ |
| ExS-7 | | $1.6 \times 10^{-4}$ |
| ExS-8 | | $7.7 \times 10^{-4}$ |
| ExC-6 | | 0.03 |
| ExM-4 | | 0.020 |
| ExM-2 | | 0.010 |
| ExM-5 | | 0.001 |
| ExM-6 | | 0.001 |
| ExM-3 | | 0.034 |
| Cpd-4 | | 0.030 |
| HBS-1 | | 0.27 |

-continued (Sample 301)

| | | |
|---|---|---|
| Polyethyl acrylate latex | | 0.15 |
| Gelatin | | 1.20 |
| D-layer (Donor layer of interlayer effect) | | |
| Silver iodobromide emulsion D (0.58 $\mu$m) | silver | 0.45 |
| ExS-6 | | $6.5 \times 10^{-4}$ |
| ExS-10 | | $2.3 \times 10^{-4}$ |
| ExM-3 | | 0.10 |
| ExM-4 | | 0.031 |
| ExY-1 | | 0.034 |
| HBS-1 | | 0.30 |
| Cpd-4 | | 0.004 |
| Gelatin | | 0.51 |
| 11th layer (Yellow filter layer) | | |
| Yellow colloidal silver | silver | 0.001 |
| Cpd-1 | | 0.11 |
| ExF-5 | | 0.15 |
| HBS-1 | | 0.05 |
| Gelatin | | 0.70 |
| 12th layer (Low-speed blue-sensitive emulsion layer) | | |
| Silver iodobromide emulsion J | silver | 0.18 |
| Silver iodobromide emulsion K | silver | 0.08 |
| Silver iodobromide emulsion L | silver | 0.36 |
| ExS-9 | | $8.4 \times 10^{-4}$ |
| ExC-1 | | 0.023 |
| ExC-8 | | $7.0 \times 10^{-3}$ |
| ExY-1 | | 0.033 |
| ExY-2 | | 0.91 |
| ExY-3 | | 0.01 |
| ExY-4 | | 0.01 |
| Cpd-2 | | 0.005 |
| Cpd-4 | | 0.001 |
| HBS-1 | | 0.28 |
| Gelatin | | 2.20 |
| 13th layer (High-speed blue-sensitive emulsion layer) | | |
| Silver iodobromide emulsion M | silver | 0.42 |
| ExS-9 | | $6.0 \times 10^{-4}$ |
| ExY-2 | | 0.16 |
| ExY-3 | | 0.001 |
| ExY-4 | | 0.002 |
| Cpd-2 | | 0.10 |
| Cpd-3 | | $1.0 \times 10^{-3}$ |
| Cpd-4 | | $5.0 \times 10^{-3}$ |
| HBS-1 | | 0.075 |
| Gelatin | | 0.70 |
| 14th layer (1st protective layer) | | |
| Silver iodobromide emulsion N | silver | 0.10 |
| UV-1 | | 0.13 |
| UV-2 | | 0.10 |

-continued (Sample 301)

| | |
|---|---|
| UV-3 | 0.16 |
| UV-4 | 0.025 |
| ExF-8 | 0.03 |
| ExF-9 | 0.005 |
| ExF-10 | 0.005 |
| ExF-11 | 0.02 |
| HBS-1 | $5.0 \times 10^{-2}$ |
| HBS-4 | $5.0 \times 10^{-2}$ |
| Gelatin | 1.8 |
| 15th layer (2nd protective layer) | |
| H-1 | 0.40 |
| B-1 (diameter 1.7 μm) | 0.04 |
| B-2 (diameter 1.7 μm) | 0.09 |
| B-3 | 0.13 |

-continued (Sample 301)

| | |
|---|---|
| ES-1 | 0.20 |
| Gelatin | 0.70 |

In addition to the above components, W-1 to W-3, B-4 to B-6, F-1 to F-18, an iron salt, a lead salt, a gold salt, a platinum salt, a palladium salt, an iridium salt and a rhodium salt were appropriately added to the individual layers in order to improve the preservability, processability, resistance to pressure, antiseptic and mildewproofing properties, antistatic properties and coating properties thereof.

TABLE 3

| | | Average AgI content (%) | Average grain size (Equivalent) spherical diameter) (μm) | COV* of grain size distribution (%) | Equivalent circular diameter of projected area (μm) | Diameter/thickness | tabularity |
|---|---|---|---|---|---|---|---|
| Emulsion | A | 3.7 | 0.37 | 13 | 0.43 | 2.3 | 12 |
| | B | 3.7 | 0.55 | 19 | 0.52 | 3.0 | 17 |
| | C | 5.4 | 0.66 | 22 | 1.1 | 6.8 | 42 |
| | D | 6.3 | 0.60 | 19 | 0.84 | 5.7 | 38 |
| | E | 3.7 | 0.37 | 13 | 0.43 | 2.3 | 12 |
| | F | 3.7 | 0.43 | 19 | 0.58 | 3.2 | 18 |
| | G | 5.4 | 0.55 | 20 | 0.86 | 6.2 | 45 |
| | H | 5.4 | 0.66 | 23 | 1.10 | 7.0 | 45 |
| | I | 5.4 | 0.72 | 23 | 1.10 | 6.3 | 36 |
| | J | 3.7 | 0.37 | 19 | 0.55 | 4.6 | 38 |
| | K | 3.7 | 0.37 | 19 | 0.55 | 4.6 | 38 |
| | L | 8.8 | 0.64 | 23 | 0.85 | 5.2 | 32 |
| | M | 6.8 | 0.88 | 30 | 1.12 | 4.7 | 20 |
| | N | 1.0 | 0.07 | — | — | 1.0 | — |

COV: Coefficient of variation

In Table 3, (1) emulsions J to M were those subjected to a reduction sensitization using thiourea dioxide and thiosulfonic acid during grain preparation in accordance with Examples of U.S. Pat. No. 5,061,614;

(2) emulsions B to D and M were those subjected to gold-, sulfur- and selenium-sensitization in the presence of sodium thiocyanate and spectral sensitizing dye described as for the individual lightsensitive layers in accordance with Examples of EP No. 443,453A;

(3) in the preparation of tabular grains, low molecular weight gelatin was used in accordance with Examples of JP-A-1-158426;

(4) at least 10 dislocation lines as described in EP No. 443,453A were observed in tabular grains by means of a high voltage electron microscope; and (5) emulsions A to E, G, H and J to M contained optimum amounts of Rh, Ir and Fe, and the tabularity is defined as $Dc/t^2$ wherein Dc represents an average equivalent circular diameter in projected area of tabular grains and t represents an average thickness of tabular grains.

Preparation of Dispersion of Organic Solid Disperse Dye

ExF-2 was dispersed by the following method. Specifically, 21.7 mL of water and 5 mL of a 10% aqueous solution of a sodium salt of dioctyl sulfosuccinate were placed in a 700-mL pot mill, and 5.0 g of dye ExF-2 and 500 mL of zirconium oxide beads (diameter 1 mm) were added to the mill. The contents were dispersed for 2 hr. This dispersion was conducted by using a BO type oscillating ball mill manufactured by Chuo Koki K.K. Thereafter, the contents were removed from the mill and added to 8 g of a 12.5% aqueous solution of gelatin. The beads were removed by filtration, thereby obtaining a gelatin dispersion of the dye. The average diameter of the dye fine grains was 0.44 μm.

Solid dispersions of ExF-3, ExF-4 and ExF-5 were obtained in the same manner. The average diameters of these dye fine grains were 0.25, 0.44, and 0.46 μm, respectively.

The thus prepared sample was designated Sample 301.

The following are chemical structures and the specific nomenclatures of the compounds used in Examples 1 to 3.

Comparative Compounds a.

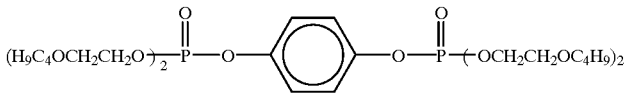

b.

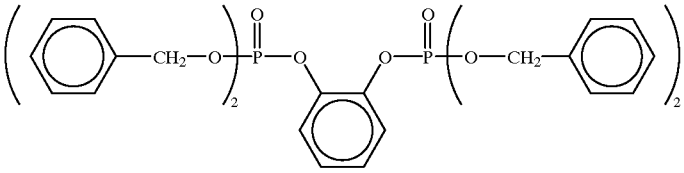

c.

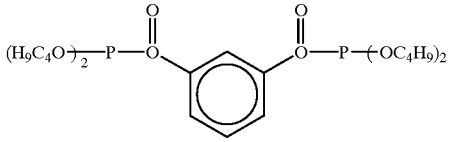

Compounds a to c are described in JP-A-2-125254 d.

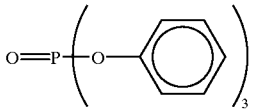

e.

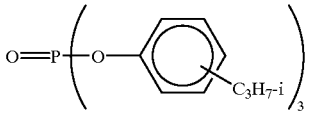

f.

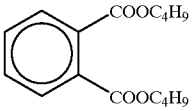

g.

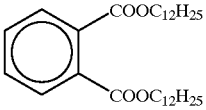

h.

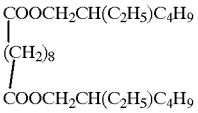

ExC-1

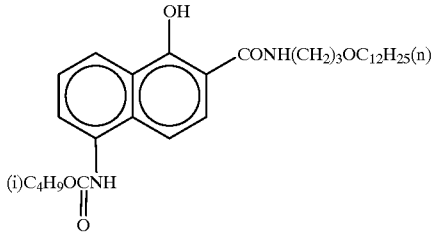

-continued
ExC-2
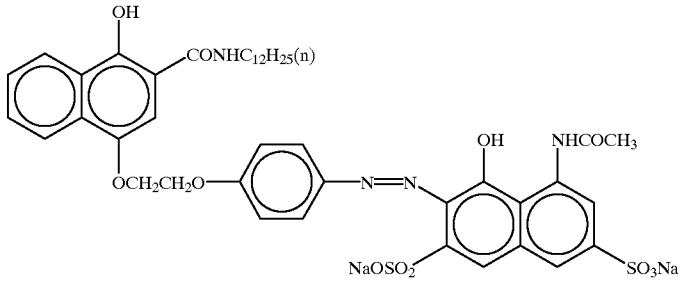
ExC-3
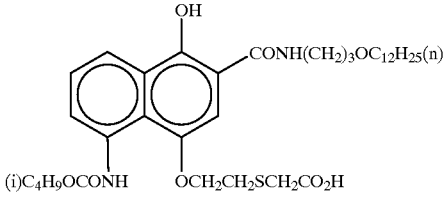
ExC-4
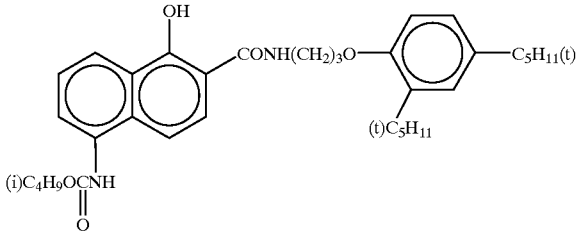
ExC-5
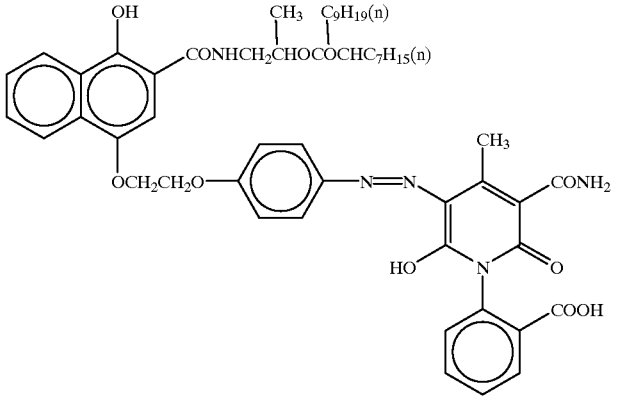
ExC-6
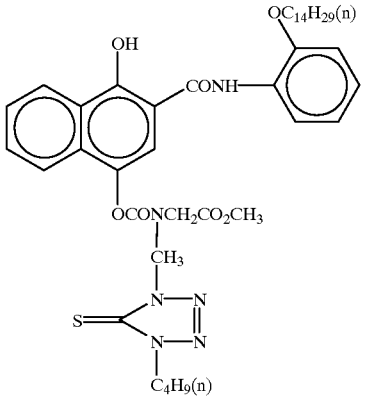

-continued
ExC-7
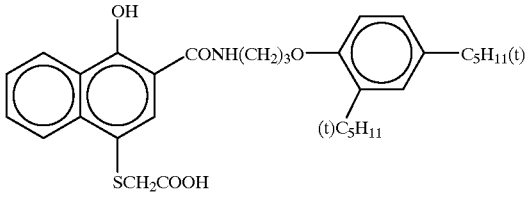
ExC-8
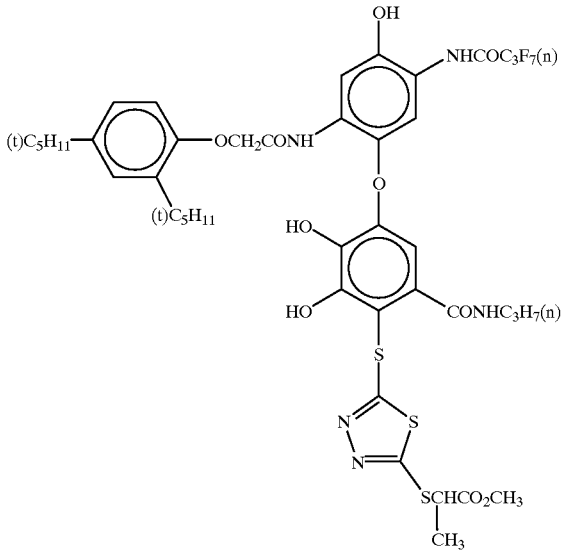
ExM-1
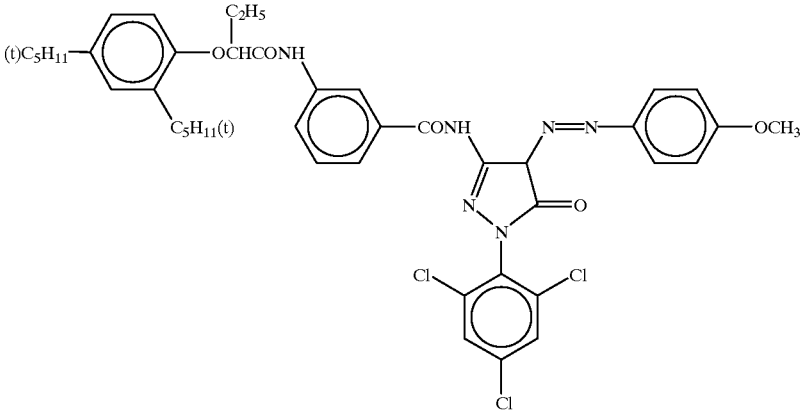
ExM-2
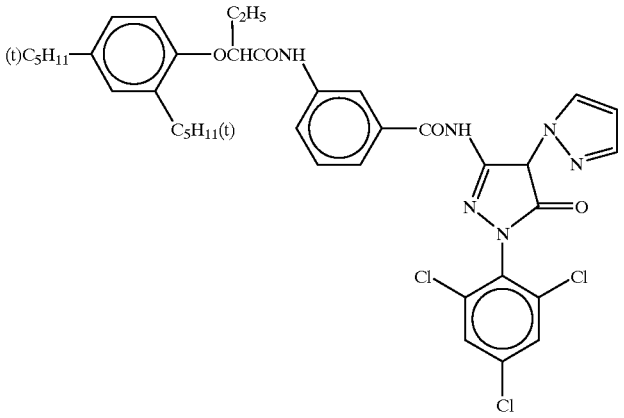

-continued
ExM-3
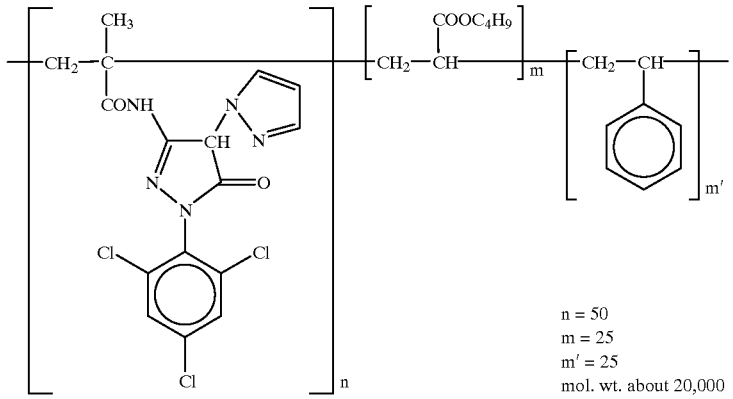
n = 50
m = 25
m′ = 25
mol. wt. about 20,000
ExM-4
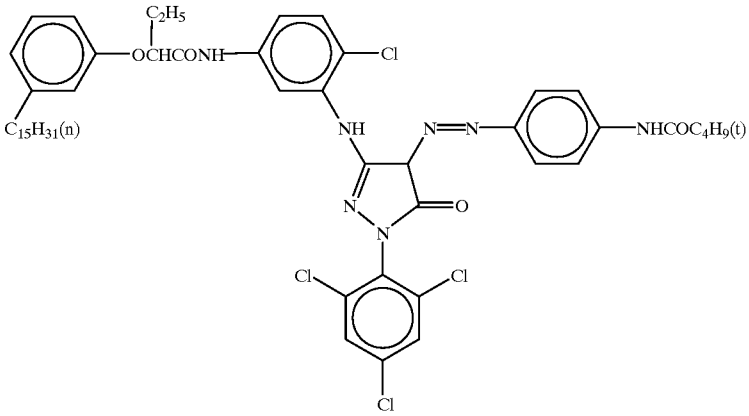
ExM-5
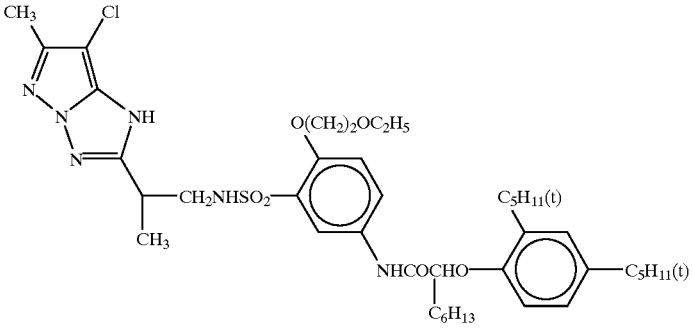
ExM-6
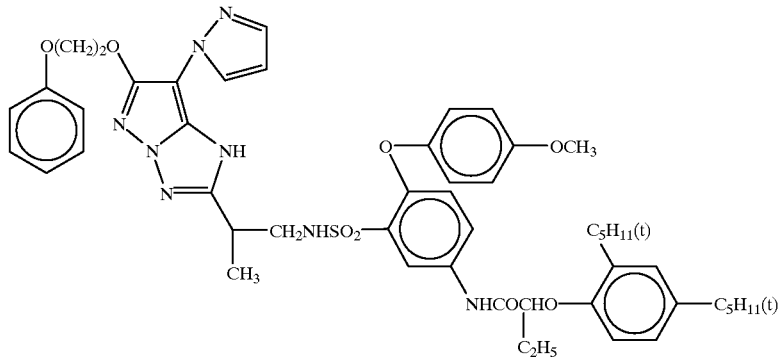

-continued
ExY-1
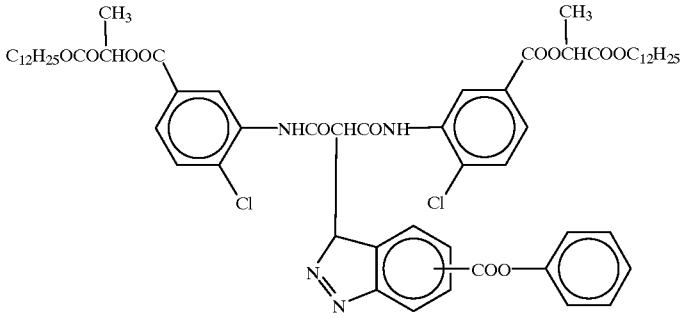
ExY-2
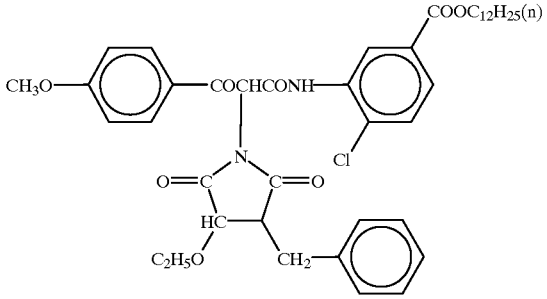
ExY-3
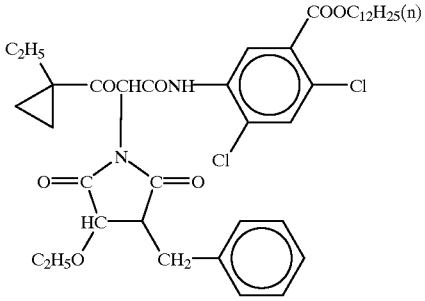
ExY-4
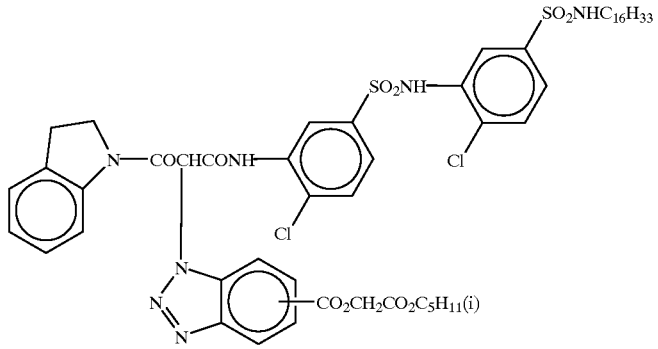
ExY-5
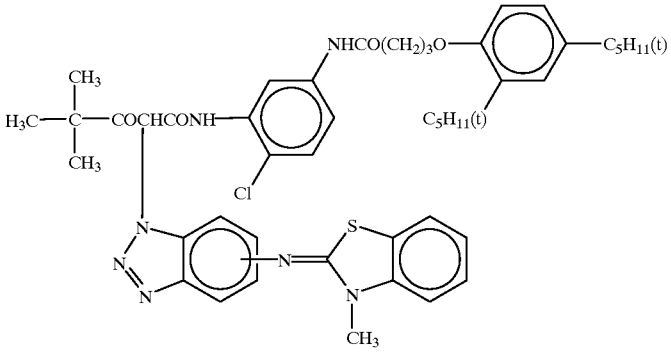

-continued
ExF-1
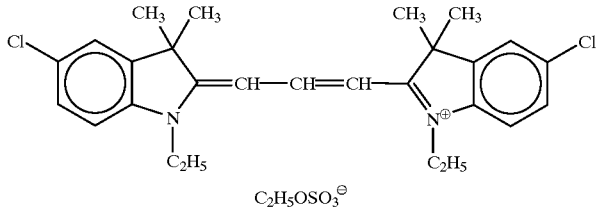
ExF-2
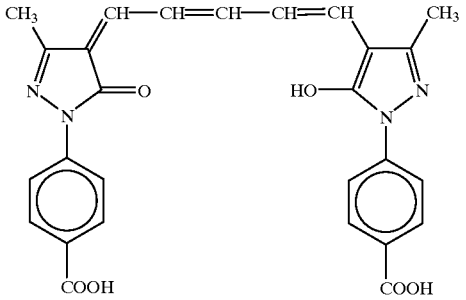
ExF-3
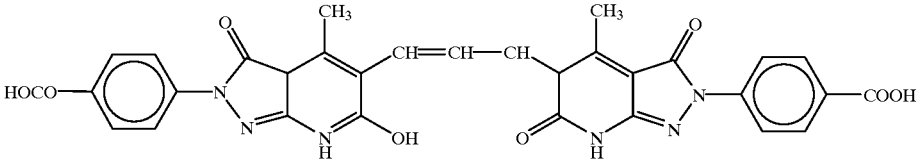
ExF-4
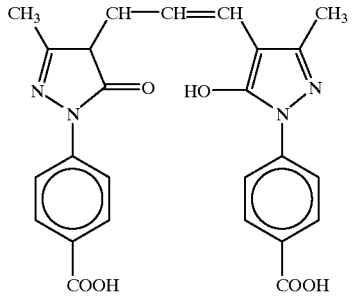
ExF-5
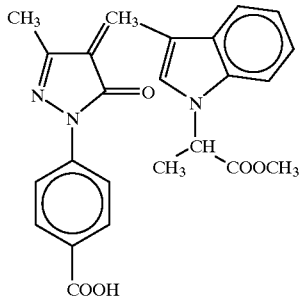
ExF-8
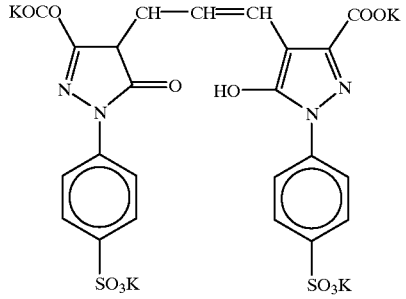

-continued
ExF-9
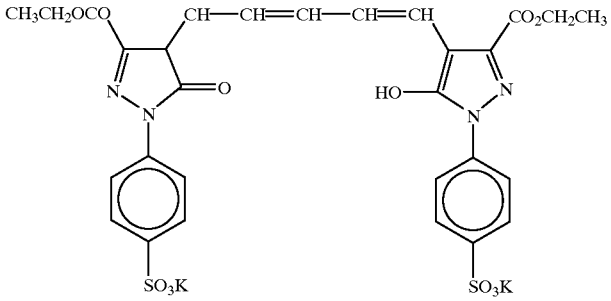
ExF-10
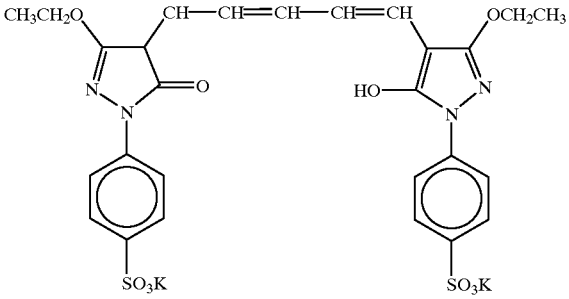
ExF-11
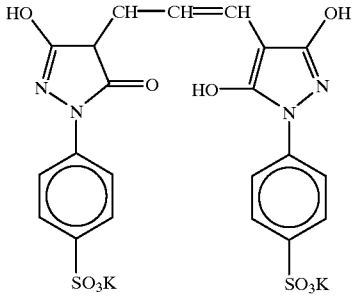
Cpd-1
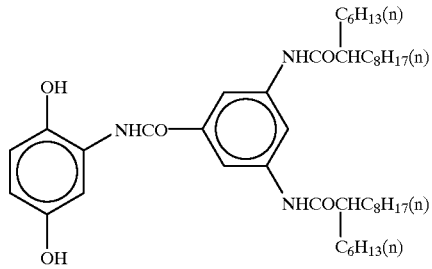
Cpd-2
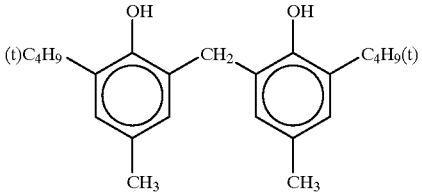
Cpd-3
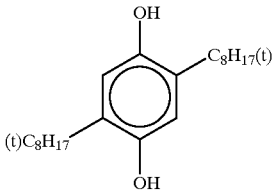
Cpd-4 $n\text{-}C_{14}H_{29}OCOCH_2CH_2CONOH$ ($CH_3$)

-continued
UV-1
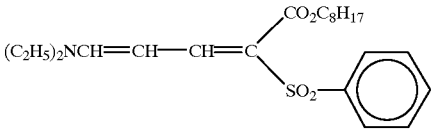
UV-2
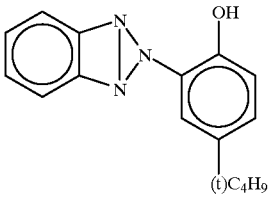
UV-3
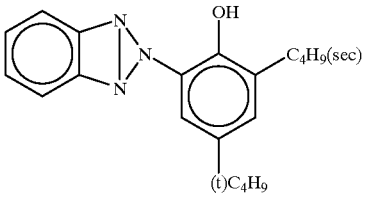
UV-4
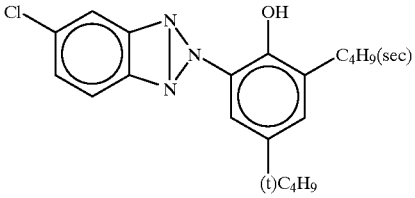
HBS-1 Tricresyl phosphate
(The same as exemplified compound (2))
HBS-2 Tributyl trimellitate
HBS-3
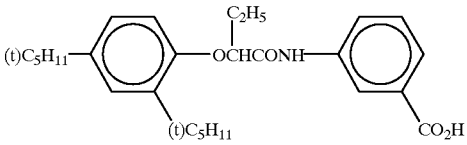
(The same as exemplified compound (121))
HBS-4 Tri(2-ethylhexyl)phosphate
(The same as exemplified compound (8))
ExS-1
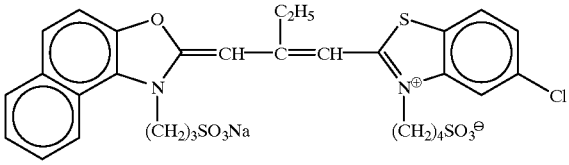
ExS-2
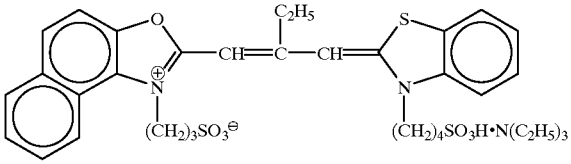
ExS-3
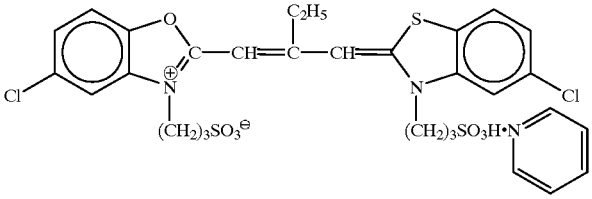

-continued
ExS-4
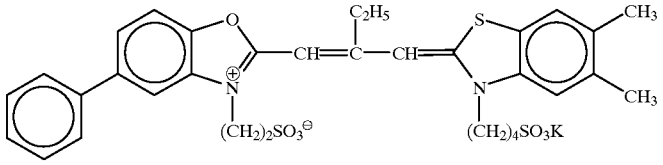
ExS-5
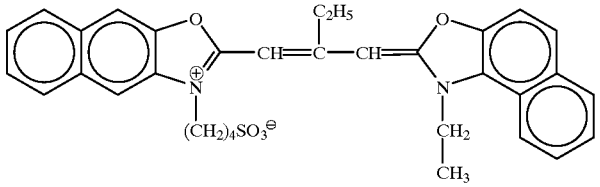
ExS-6
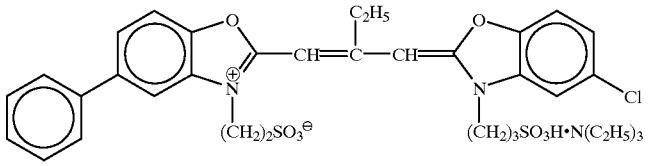
ExS-7
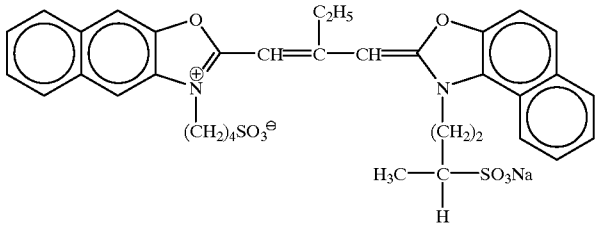
ExS-8
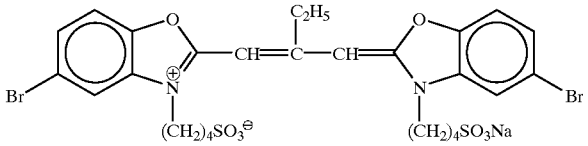
ExS-9
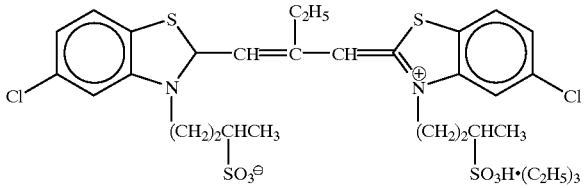
ExS-10
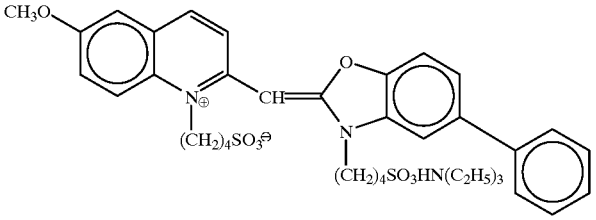
ES-1
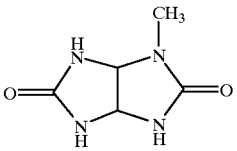
H-1
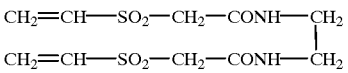

-continued
B-1
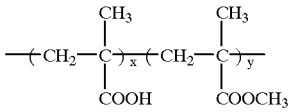
x/y = 10/90
Av. mol. wt: about 35,000
B-2
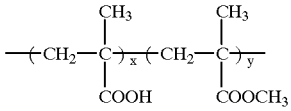
x/y = 45/60
Av. mol. wt: about 20,000
B-3
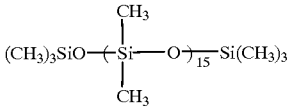
B-4
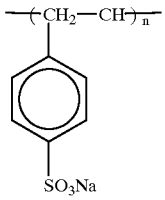
Av. mol. wt: about 750,000
B-5
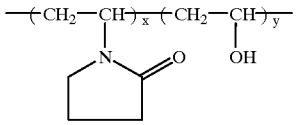
x/y = 70/30
Av. mol. wt: about 17,000
B-6
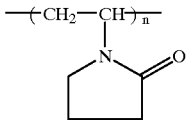
Av. mol. wt: about 10,000
W-1
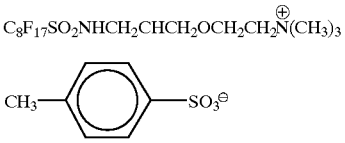
W-2 $C_{12}H_{25}(OCH_2CH_2)_n—SO_3Na$
$_n$=2–4
W-3
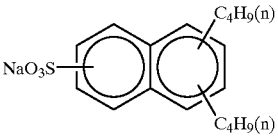
F-1
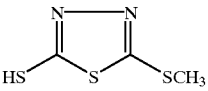

-continued
F-2
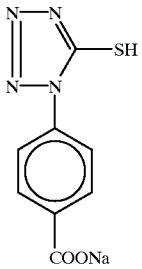
F-3
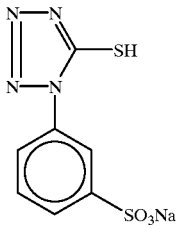
F-4
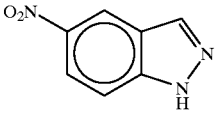
F-5
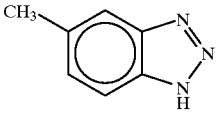
F-6
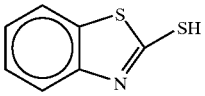
F-7
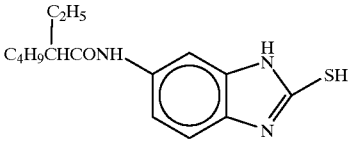
F-8
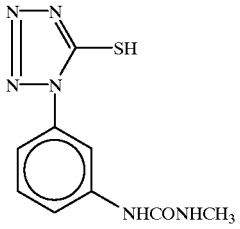
F-9
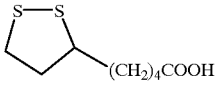
F-10
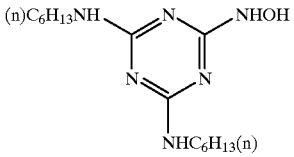
F-11
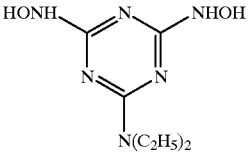

-continued

F-12

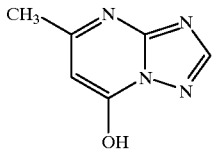

F-13

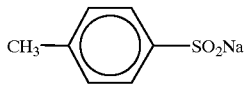

F-14

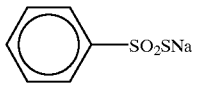

F-15

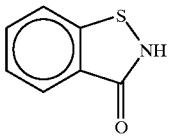

F-16

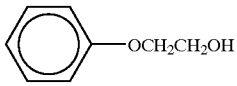

F-17

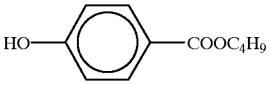

F-18

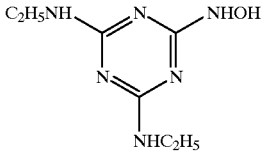

(Preparation of Samples 302 to 306)

Samples 302 to 306 were prepared in the same manner as in the preparation of Sample 301, except that the HBS-1 contained in the 8th layer of Sample 301 was replaced by each of the high-boiling-point organic solvents 1, 2 and 3 of the present invention and the above comparative high-boiling-point organic solvents (d) and (f), respectively. The use amount of each of the high-boiling-point organic solvents was determined so that the gradation of the green-sensitive silver halide emulsion layer of each sample becomes the same as Sample 301. When the HBS-1 was replaced by each of the comparative high-boiling-point organic solvents (a), (b), (c), (e), (g) and (h), however, the gradation became soft, and the gradation could not become the same as that of Sample 301 by increasing the use amount thereof within practical ranges. Thus, a sample preparation was abandoned in use of these high-boiling-point organic solvents.

(Test on Photographic Performance Change Under Ultrahigh Humidity Conditions)

With respect to each of the Samples 301 to 306, two sets of films were prepared, and one set was stored in a relative humidity of 65% at 40° C. for 16 hr (storage condition A: comparative standard humidity condition) while the other set was stored in a relative humidity of 100% at 40° C. for 16 hr (storage condition B).

The resultant individual sample films were subjected to wedge exposure conducted with the use of white light and thereafter to development processing as described below. Sensitometry of the processed samples was performed to thereby determine the magenta density at specified exposure amount, i.e., exposure such that, under storage condition A of Sample 301, the shoulder part of magenta gradation giving a density of about 2.5 in terms of color density, is realized. With respect to each of the Samples 301 to 306, the value, i.e., difference, of magenta density under storage condition B minus magenta density under storage condition A was determined as a parameter of the magenta density lowering caused by the storage under ultrahigh humidity conditions.

The results are given in Table 4 below.

TABLE 4

| Sample No. | Solvent* | Decrement of magenta density |
|---|---|---|
| 301 (Comp) | HBS-1 | −0.30 |
| 302 (Inv) | 1 | +0.03 |
| 303 (Inv) | 2 | +0.02 |
| 304 (Inv) | 3 | +0.02 |
| 305 (Comp) | d | −0.46 |
| 306 (Comp) | f | −0.25 |

*High-boiling-point organic solvent

It is apparent from Table 4 that the gradation softening and magenta density lowering caused by the storage under ultrahigh humidity conditions are slight with respect to the samples in which the high-boiling-point organic solvents of the present invention are used.

The method of development processing will be described below.

The above color photographic lightsensitive materials were exposed and processed with the use of Negative Processor FP-350 manufactured by Fuji Photo Film Co., Ltd. in accordance with the following method (until the cumulative amount of replenisher became thrice the tank volume of mother liquor). (Processing steps)

| Step | Time | Temp. ° C. | Replenishment rate |
|---|---|---|---|
| Color development | 3 min 15 sec | 38 | 45 mL |
| Bleaching | 1 min 00 sec | 38 | 20 mL whole of bleaching soln. overflow flows into bleach-fix tank |
| Bleach-fix | 3 min 15 sec | 38 | 30 mL |
| Water washing (1) | 40 sec | 35 | countercurrent flow from (2) to (1) |
| Water washing (2) | 1 min 00 sec | 35 | 30 mL |
| Stabilization | 40 sec | 38 | 20 mL |
| Drying | 1 min 15 sec | 55 | |

The replenishment rate is represented by a value per 1.1 m of a 35-mm wide sample (equivalent to one 24 Ex. film).

The composition of each processing solution was as follows.

| (Color developer) | Tank soln. (g) | Replenisher (g) |
|---|---|---|
| Diethylenetriamine pentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water | q.s. ad 1.0 L | |
| pH | 9.60 | 9.60 |

This pH was adjusted by the use of sulfuric acid and potassium hydroxide.

| (Bleaching soln.) | Common to Tank solution and Replenisher (g) |
|---|---|
| Fe(III) ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Aq. ammonia (27%) | 15.0 mL |
| Water | q.s. ad 1.0 L |
| pH | 6.3 |

This pH was adjusted by aqueous ammonia and nitric acid.

| (Bleach-fix) | Tank soln. (g) | Replenisher (g) |
|---|---|---|
| Fe(III) ammonium ethylenediaminetetraacetate dihydrate | 50.0 | — |
| Disodium ethylenediaminetetraacetate | 5.0 | 2.0 |
| Sodium sulfite | 12.0 | 20.0 |
| Aq. soln. of ammonium thiosulfate (700 g/L) | 240.0 mL | 400.0 mL |
| Aq. ammonia (27%) | 6.0 mL | — |
| Water | q.s. ad 1.0 L | |
| pH | 7.2 | 7.3 |

This pH was adjusted by aqueous ammonia and acetic acid.

(Washing Water): Common to Tank Solution and Replenisher

Tap water was passed through a mixed-bed column filled with an H type strongly acidic cation exchange resin (Amberlite IR-120B: available from Rohm & Haas Co.) and an OH type anion exchange resin (Amberlite IR-400) to adjust the concentrations of calcium and magnesium ions to be 3 mg/L or less. Subsequently, 20 mg/L of sodium dichloroisocyanurate and 0.15 g/L of sodium sulfate were added. The pH of the solution ranged from 6.5 to 7.5.

| (Stabilizer): common to tank solution and replenisher (g) | |
|---|---|
| Sodium p-toluenesulfinate | 0.03 |
| Polyoxyethylene p-monononylphenyl ether (average polymerization degree 10) | 0.2 |
| Disodium ethylenediaminetetraacetate | 0.05 |
| 1,2,4-triazole | 1.3 |
| 1,4-bis(1,2,4-triazol-1-ylmethyl)-piperazine | 0.75 |
| 1,2-benzoisothiazolin-3-one | 0.10 |
| Water | q.s. ad 1.0 L |
| pH | 8.5 |

Example 4

Surface of a support consisting of a paper having its both sides coated with a polyethylene resin was treated with corona discharge, furnished with a gelatin subbing layer containing sodium dodecylbenzenesulfonate and sequentially coated with the first to seventh photographic constituting element layers. Thus, there was obtained silver halide color photographic lightsensitive material Sample 400 of the following layer arrangement. The coating liquid for each of the photographic constituting element layers was prepared in the following manner.

Preparation of Fifth-layer Coating Liquid 300 g of cyan coupler (ExC-1), 250 g of color image stabilizer (Cpd-1), log of color image stabilizer (Cpd-9), 10 g of color image stabilizer (Cpd-10), 20 g of color image stabilizer (Cpd-12), 14 g of ultraviolet absorber (UV-1), 50 g of ultraviolet absorber (UV-2), 40 g of ultraviolet absorber (UV-3) and 60 g of ultraviolet absorber (UV-4) were dissolved in 230 g of solvent (Solv-6) and 350 mL of ethyl acetate. This solution was emulsified and dispersed in 6500 g of a 10% aqueous gelatin solution containing 200 mL of 10% sodium dodecylbenzenesulfonate. Thus, emulsion dispersion C was obtained.

On the other hand, silver chlorobromide emulsion C (cube; a 1:4 (silver molar ratio) mixture of large-size emulsion C having an average grain size of 0.50 $\mu$m and small-size emulsion C having an average grain size of 0.41 $\mu$m; variation coefficients of grain size distribution of the large-size emulsion C and the small-size emulsion C are 0.09 and 0.11, respectively; and the grains of both large- and small-seize emulsions are composed of a base comprising silver chloride and having 0.5 mol % of silver bromide that is localized on a part of the grain surface) was prepared.

This emulsion was doped with each of the following red-sensitive sensitizing dyes G and H in an amount of $6.0\times10^{-5}$ mol per mol of silver for the large-size emulsion C and $9.0\times10^{-5}$ mol per mol of silver for the small-size emulsion C. The chemical sensitization of this emulsion was optimally effected by adding a sulfur sensitizer and a gold sensitizer thereto.

The aforementioned emulsion dispersion C and this silver chlorobromide emulsion C were subjected to mixing dissolution, thereby obtaining a fifth-layer coating liquid of the composition indicated below. The emulsion coating amount is that in terms of silver quantity.

The coating liquids for the first to fourth and sixth to seventh layers were prepared in the same manner as described above with respect to the coating liquid for the fifth layer. In each of the layers, sodium salt of 1-oxy-3,5-dichloro-s-triazine was used as the gelatin hardener.

Further, each of the layers was doped with Ab-1, Ab-2, Ab-3 and Ab-4, set forth below, so that the total amounts thereof became 15.0 mg/m$^2$, 60.0 mg/m2, 5.0 mg/m$^2$ and 10.0 mg/m$^2$, respectively.

(Ab-1) Antiseptic

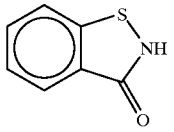

(Ab-2) Antiseptic

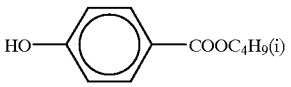

(Ab-3) Antiseptic

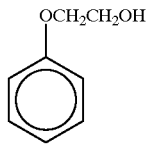

-continued (Ab-4) Antiseptic

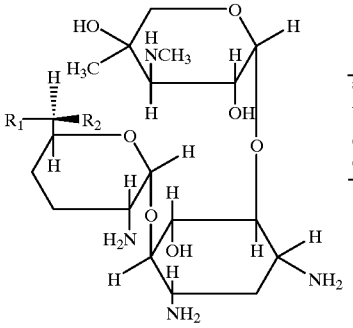

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A 1:1:1:1 mixture of a, b, c and d.

The following spectral sensitizing dyes were used in the silver chlorobromide emulsion of individual lightsensitive emulsion layers.

In the blue-sensitive emulsion layer, use was made of:

(Sensitizing dye A)

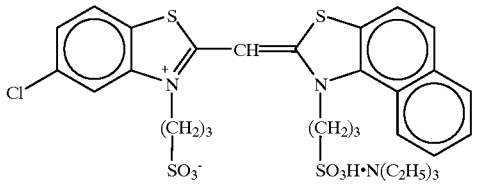

(Sensitizing dye B)

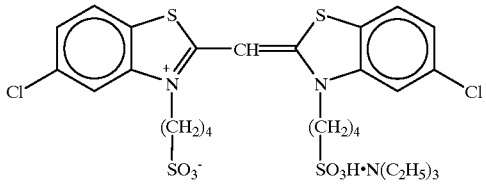

(Sensitizing dye C)

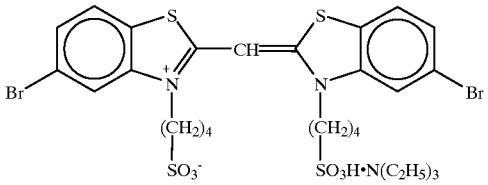

(each of sensitizing dyes A, B and C was added in an amount of $1.4\times10^{-4}$ mol per mol of silver halide for the large-size emulsion and each $1.7\times10^{-4}$ mol per mol of silver halide for the small-size emulsion).

In the green-sensitive emulsion layer, use was made of:

(Sensitizing dye D)

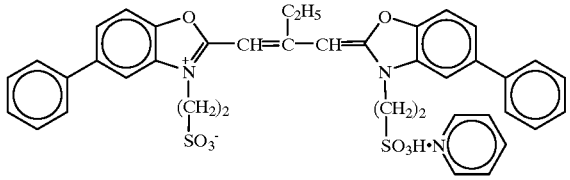

-continued (Sensitizing dye E)

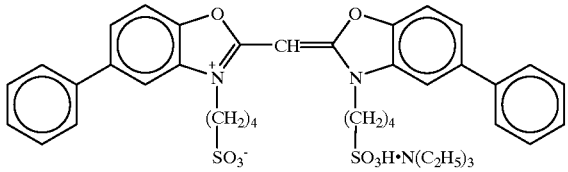

(sensitizing dye D was added in an amount of $3.0\times10^{-4}$ mol per mol of silver halide for the large-size emulsion and $3.6\times10^{-4}$ mol per mol of silver halide for the small-size emulsion; sensitizing dye E was added in an amount of $4.0\times10^{-5}$ mol per mol of silver halide for the large-size emulsion and $7.0\times10^{-5}$ mol per mol of silver halide for the small-size emulsion; and sensitizing dye F was added in an amount of $2.0\times10^{-4}$ mol per mol of silver halide for the large-size emulsion and $2.8\times10^{-4}$ mol per mol of silver halide for the small-size emulsion).

In the red-sensitive emulsion layer, use was made of:

(Sensitizing dye G)

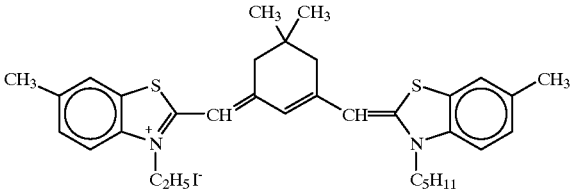

(Sensitizing dye H)

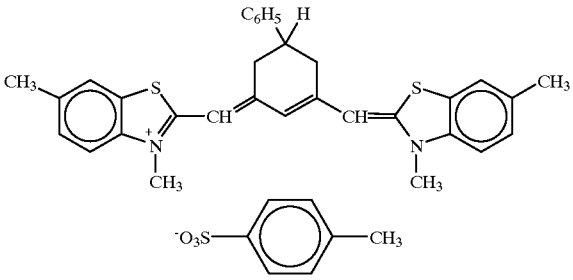

(each of sensitizing dyes G and H was added in an amount of $6.0\times10^{-5}$ mol per mol of silver halide for the large-size emulsion and $9.0\times10^{-5}$ mol per mol of silver halide for the small-size emulsion).

The red-sensitive emulsion layer was further doped with $2.6\times10^{-3}$ mol, per mol of silver halide, of the following compound I:

(Compound I)

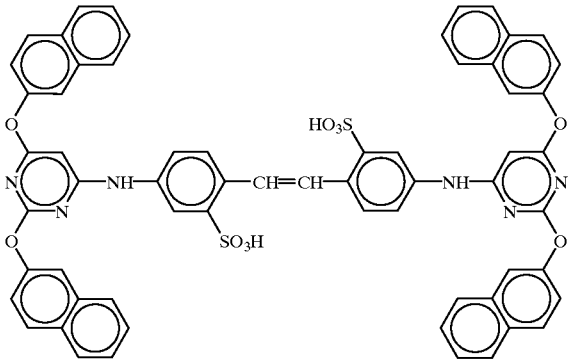

Still further, the blue-sensitive emulsion layer, the green-sensitive emulsion layer and the red-sensitive emulsion layer were respectively doped with $3.3\times10^{-4}$ mol, $1.0\times10^{-3}$ mol and $5.9\times10^{4}$ mol, per mol of silver halide, of 1-(3-methylureidophenyl)-5-mercaptotetrazole.

Furthermore, the second, fourth, sixth and seventh layers were doped with the above compound in amounts of 0.2 mg/m$^2$, 0.2 mg/m$^2$, 0.6 mg/m$^2$ and 0.1 mg/m$^2$, respectively.

Still further, the blue-sensitive emulsion layer and the green-sensitive emulsion layer were doped with 4-hydroxy-6-methyl-1,3,3a,7-tetrazaindene in amounts of $1\times10^{-4}$ mol and $2\times10^{-4}$ mol, per mol of silver halide, respectively.

The red-sensitive emulsion layer was doped with 0.05 g/m$^2$ of copolymer of methacrylic acid and butyl acrylate (weight ratio: 1/1; and average molecular weight: 200,000 to 400,000).

The second, fourth and sixth layers were doped with disodium catechol-3,5-disulfonate in amounts of 6 mg/m$^2$, 6 mg/m$^2$ and 18 mg/m$^2$, respectively.

For preventing irradiation, the emulsion layers were doped with the following dyes (coating amount indicated in parentheses).

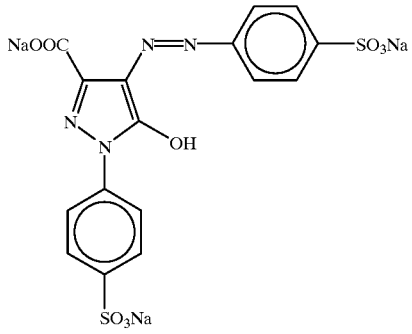

(10 mg/m$^2$)

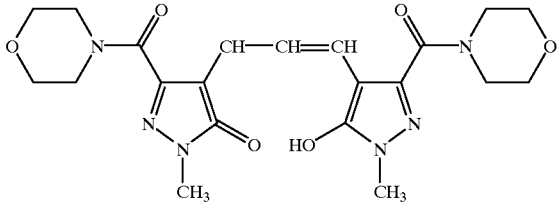

(20 mg/m$^2$)

-continued

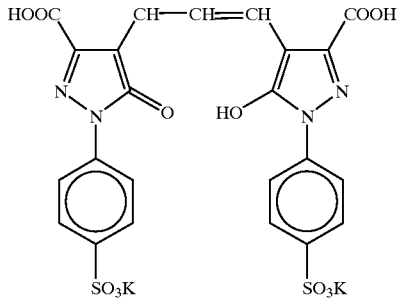

(5 mg/m$^2$)

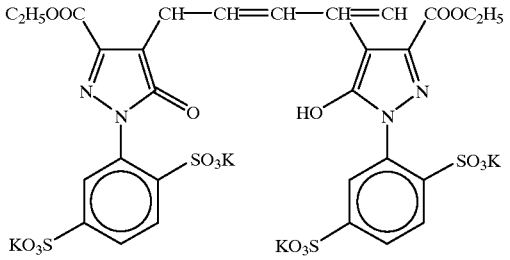

(20 mg/m$^2$)

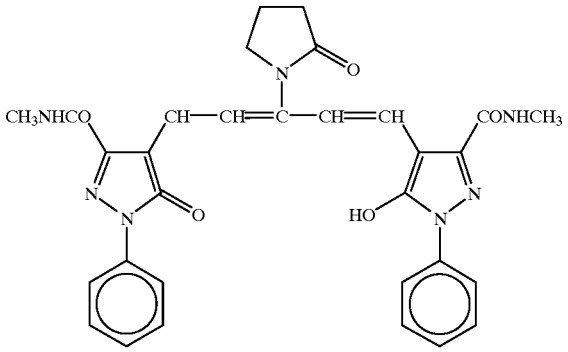

(20 mg/m$^2$)

The composition of each layer is specified below. The numeral indicates the coating amount (g/m$^2$). With respect to the silver halide emulsion, the coating amount is in terms of silver.

| | |
|---|---|
| Support | |
| Polyethylene resin laminated paper (polyethylene resin on the 1st layer side containing white pigment (TiO2 content: 16% by weight and ZnO content: 4% by weight), brightening agent (a 8:2 mixture of 4,4'-bis(benzoxazolyl)stilbene and 4,4'-bis(5-methylbenzoxazolyl)stilbene contained in an amount of 0.05% by weight) and bluish dye (ultramarine)). | |
| First layer (blue-sensitive emulsion layer) | |
| Silver chlorobromide emulsion (cube; a 3:7 (silver molar ratio) mixture of large-size emulsion A having an average grain size of 0.72 μm and small-size emulsion A having an average grain size of 0.60 μm; variation coefficients of grain size distribution of the large-size emulsion A and the small-size emulsion A are 0.08 and 0.10, respectively; and each of the grains of both emulsions are composed of silver chloride as a base and 0.3 mol % of silver bromide that is localized on a part of the grain surface) | 0.26 |
| Gelatin | 1.35 |
| Yellow coupler (ExY) | 0.62 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.23 |
| Second layer (color mixing inhibiting layer) | |
| Gelatin | 0.99 |
| Color mixing inhibitor (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-2) | 0.28 |
| Third layer (green-sensitive emulsion layer) | |
| Silver chlorobromide emulsion B (cube; a 1:3 (silver molar ratio) mixture of large-size emulsion B having an average grain size of 0.45 μm and small-size emulsion B having an average grain size of 0.35 μm; variation coefficients of grain size distribution of the large-size emulsion B and the small-size emulsion B are 0.10 and 0.08, respectively; and each of the grains of both emulsions are composed of silver chloride as a base and 0.4 mol % of silver bromide that is localized on a part of the grain surface) | 0.14 |
| Gelatin | 1.36 |
| Magenta coupler (ExM) | 0.15 |
| Ultraviolet absorber (UV-1) | 0.05 |
| Ultraviolet absorber (UV-2) | 0.03 |
| Ultraviolet absorber (UV-3) | 0.02 |
| Ultraviolet absorber (UV-4) | 0.04 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth layer (color mixing inhibiting layer) | |
| Gelatin | 0.71 |
| Color mixing inhibitor (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-2) | 0.20 |
| Fifth layer (red-sensitive emulsion layer) | |
| Silver chlorobromide emulsion C (cube; a 1:4 (silver molar ratio) mixture of large-size emulsion C having an average grain size of 0.50 μm and small-size emulsion C having an average grain size of 0.41 μm; variation coefficients of grain size distribution of the large-size emulsion C and the small-size emulsion C are 0.09 and 0.11, respectively; and each of the grains of both emulsions are composed of silver chloride as a base and 0.5 mol % of silver bromide that is localized on a part of the grain surface) | 0.20 |
| Gelatin | 1.11 |
| Cyan coupler (ExC-1) | 0.30 |
| Ultraviolet absorber (UV-1) | 0.14 |
| Ultraviolet absorber (UV-2) | 0.05 |
| Ultraviolet absorber (UV-3) | 0.04 |
| Ultraviolet absorber (UV-4) | 0.06 |
| Color image stabilizer (Cpd-1) | 0.25 |
| Color image stabilizer (Cpd-9) | 0.01 |
| Color image stabilizer (Cpd-10) | 0.01 |
| Color image stabilizer (Cpd-12) | 0.02 |
| Solvent (Solv-6) | 0.23 |

-continued

| Sixth layer (ultraviolet absorbing layer) | |
|---|---|
| Gelatin | 0.66 |
| Ultraviolet absorber (UV-1) | 0.19 |
| Ultraviolet absorber (UV-2) | 0.06 |
| Ultraviolet absorber (UV-3) | 0.06 |
| Ultraviolet absorber (UV-4) | 0.05 |
| Ultraviolet absorber (UV-5) | 0.09 |
| Solvent (Solv-7) | 0.25 |

-continued

| Seventh layer (protective layer) | |
|---|---|
| Gelatin | 1.00 |
| Acryl modified copolymer of polyvinyl alcohol (deg. of modification 17%) | 0.04 |
| Liq. paraffin | 0.02 |
| Surfactant (Cpd-13) | 0.01 |

The following chemical structures are of the compounds used in this Example.

(ExY) Yellow coupler
A 60:40 mixture of

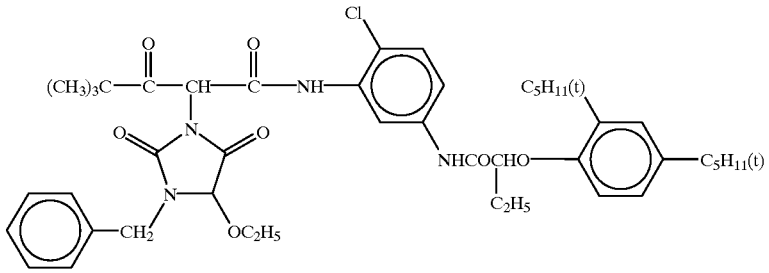

and

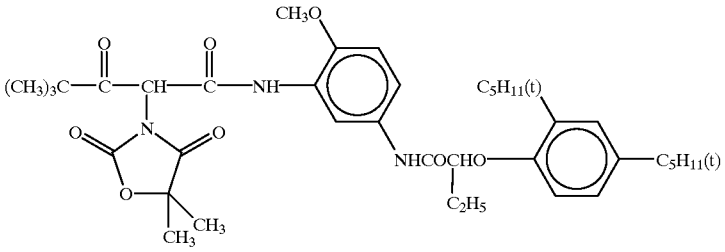

(ExM) Magenta coupler
A 60:40 mixture of

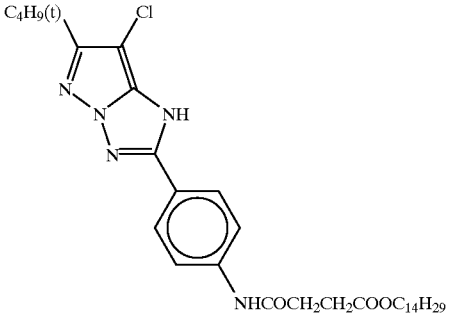

and

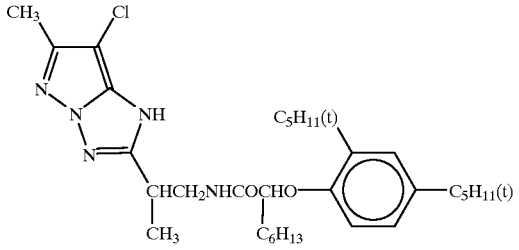

(ExC-1) Cyan Coupler
A 15:85 mixture of

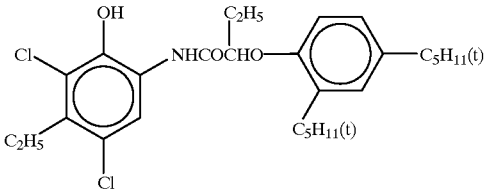

and

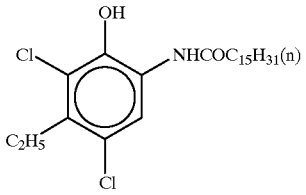

-continued
(ExC-2) Cyan coupler
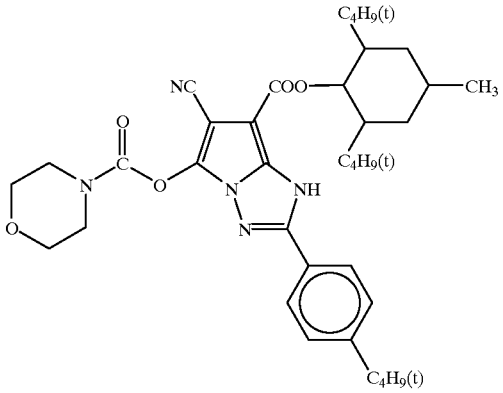
(ExC-3) Cyan coupler
A 50:25:25 mixture of
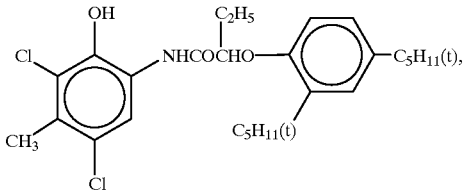
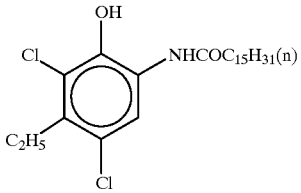
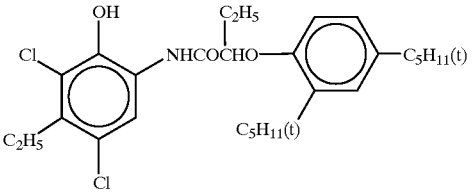
and
(Cpd-1)
Color image stabilizer
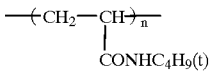
Number av. mol.
wt: 60,000
(Cpd-2)
Color image stabilizer
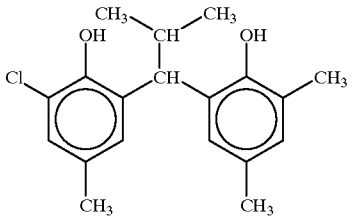
(Cpd-3)
Color image stabilizer
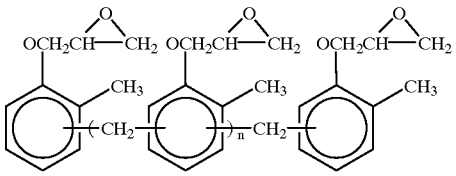
n = 7–8 (Average)
(Cpd-4)
Color-mixing preventing agent
A 1:1:1 mixture of
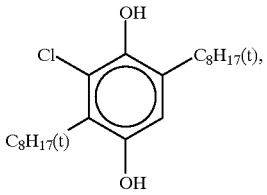
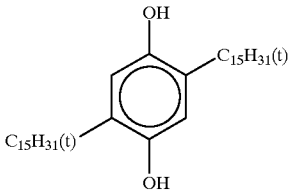
and -continued
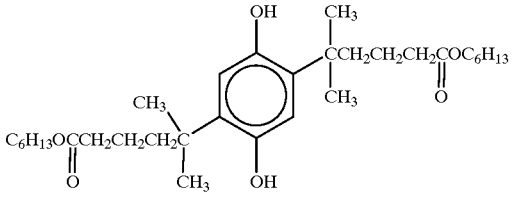
(Cpd-6)
Stabilizer
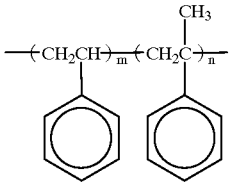
Number. av. mol. wt: 600m/n=10/90
(Cpd-5)
Color mixing preventing agent
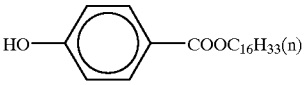
(Cpd-7)
Color-mixing preventing agent
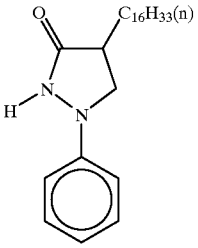
(Cpd-8)
Color image stabilizer
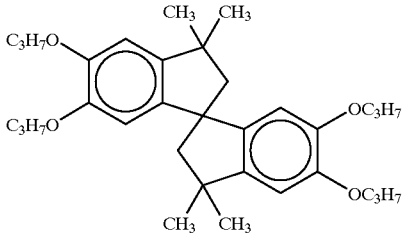
(Cpd-9)
Color image stabilizer
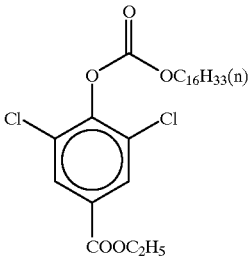
(Cpd-10)
Color image stabilizer
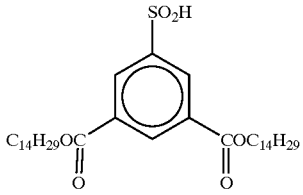
(Cpd-11)
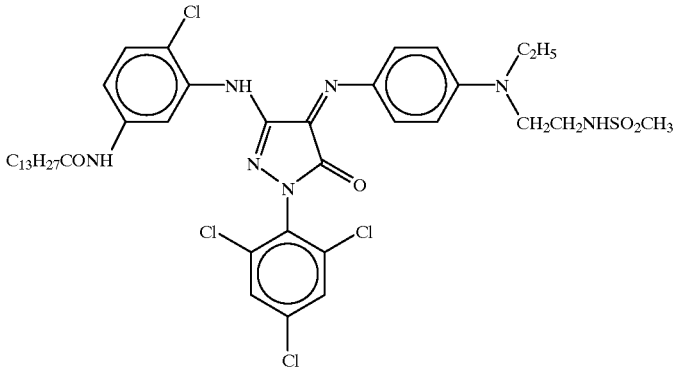

-continued
(Cpd-12)
Color image stabilizer
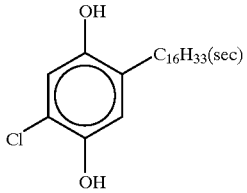
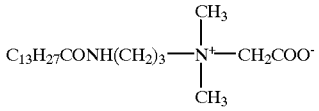
(Cpd-13)
Surfactance
A 7:3 mixture of
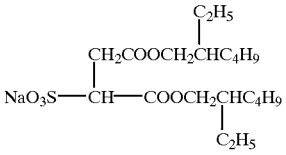
and
(Cpd-14)
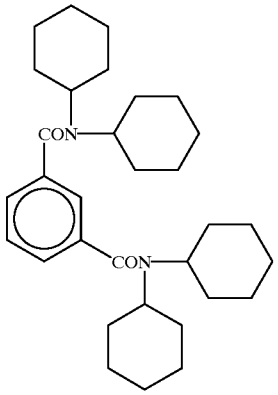
(Cpd-15)
A 1:1 mixture of
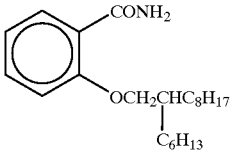
and
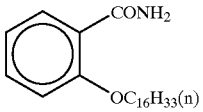
(Cpd-16)
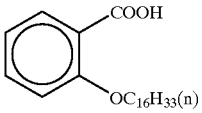
(Cpd-17)
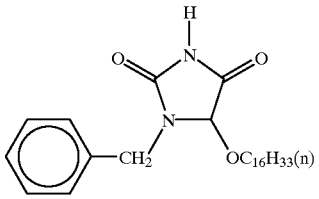
(Cpd-18)
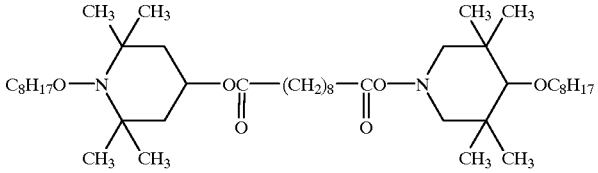
(UV-1)
UV-absorbent
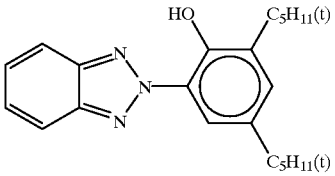
(UV-2)
UV-absorbent
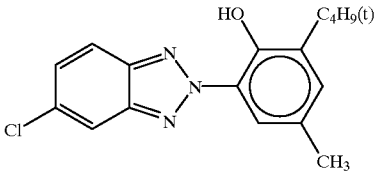

-continued (UV-3)
UV-absorbent

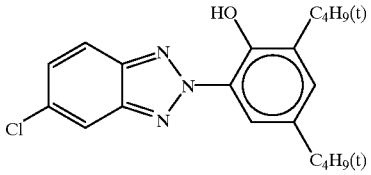

(UV-4)
UV-absorbent

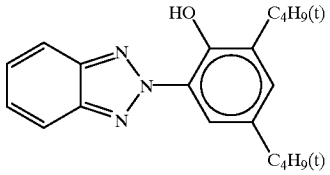

(UV-5)
UV-absorbent

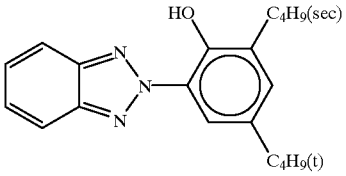

(Solv -1)

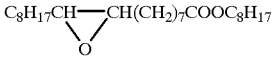

(Solv -2)

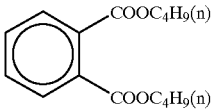

(Solv -3)

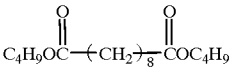

(Solv -4)

(Solv -5)

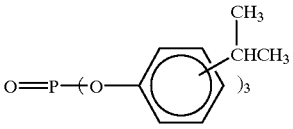

(Solv -6)

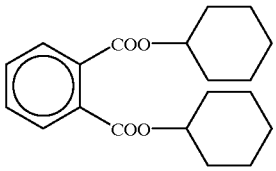

(Solv -7)

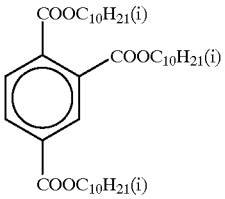

(Solv -8)

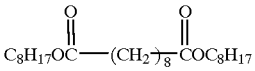

(Solv -9)

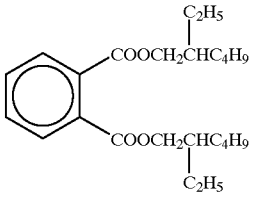

Furthermore, Sample 401 was prepared in the same manner as the thus prepared silver halide color photographic lightsensitive material 400, except that the composition of the fifth layer of Sample 400 was changed as follows.

| Fifth layer (red-sensitive emulsion layer) | |
|---|---|
| silver chlorobromide emulsion C (cube; a 1:4 (silver molar ratio) mixture of large-size emulsion C having an average grain size of 0.50 μm and small-size emulsion C having an average grain size of 0.41 μm; variation coefficients of grain size distribution of the large-size emulsion C and the small-size emulsion C are 0.09 and 0.11, respectively; and each of the grains of both emulsions are composed of silver chloride as a base and 0.8 mol % of silver bromide that is localized on a part of the grain surface) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.05 |

-continued

| Fifth layer (red-sensitive emulsion layer) | |
|---|---|
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.06 |
| Color image stabilizer (Cpd-16) | 0.09 |
| Color image stabilizer (Cpd-17) | 0.09 |
| Color image stabilizer (Cpd-18) | 0.01 |
| Solvent (Solv-5) | 0.15 |
| Solvent (Solv-8) | 0.05 |
| Solvent (Solv-9) | 0.10 |

Samples 402 to 406 were prepared in the same manner as in the preparation of Sample 401, except that the high-boiling-point organic solvent Solv-2 (same as the aforementioned solvent (f)) contained in the fourth layer of Sample 401 was replaced by the same weight of each of the above high-boiling-point organic solvents HBS-1, (1), (2), (3) and (d), respectively.

The Samples 401 to 406 were subjected to wedge exposure conducted with the use of red light, and development processing and density measurement were carried out as described below. The magenta color density in an exposure resion imparting the maximum density with respect to the cyan color density was determined to thereby investigate the reactivity of the color mixing inhibitor contained in the fourth layer. It can be stated that, the lower the magenta density, the higher the reactivity of the color mixing inhibitor, so that favorably the color turbidity tends to be reduced.

Further, these samples were exposed to 30 thousand lux xenon light for a period of three weeks, and the density measurement was conducted once more. The ratio of residual cyan density after the exposure at a portion where the cyan density before the exposure was 2.0, was determined as a parameter for the resistance to light of cyan image. The test results are summarized in Table 5 below.

TABLE 5

| Sample No. | Solvent* | Magenta density (Color-mixing) | Residual ratio of cyan density (Resistance to light) |
|---|---|---|---|
| 401 (Comp) | Solv-2 (f) | 0.24 | 76% |
| 402 (Comp) | HBS-1 | 0.25 | 69% |
| 403 (Inv) | 1 | 0.22 | 81% |
| 404 (Inv) | 2 | 0.21 | 83% |
| 405 (Inv) | 3 | 0.23 | 79% |
| 406 (Comp) | d | 0.24 | 61% |

*High-boiling-point organic solvent

It is apparent from Table 5 that, with respect to the samples using the high-boiling-point organic solvents of the present invention, the mixing of magenta density into cyan density is effectively suppressed and the resistance to light of cyan image is improved.

It is presumed that the high-boiling-point organic solvents of the present invention not only enhance the reactivity of color mixing inhibitors but also probably suppress the diffusion of the high-boiling-point organic solvents per se into the red-sensitive silver halide emulsion layer, i.e., the fifth layer, to thereby enable avoiding unfavorable effects on the resistance to light of cyan image.

The method of development processing will be described below.

The above mentioned lightsensitive material was formed into 127 mm wide rolls and, with the use of Printer Processor PP1820V manufactured by Fuji Photo Film Co., Ltd., there were carried out imagewise exposure and continuous processing (running test) in accordance with the following steps until the cumulative amount of replenisher became twice the volume of color development tank.

| Processing Step | Temp. | Time | Replenishment rate* |
|---|---|---|---|
| Color development | 38.5° C. | 45 sec | 45 mL |
| Bleach-fix | 38° C. | 45 sec | 35 mL |
| Rinse (1) | 38° C. | 22 sec | — |
| Rinse (2) | 38° C. | 22 sec | — |
| Rinse (3) | 38° C. | 22 sec | 175 mL |
| Rinse (4) | 38° C. | 22 sec | — |
| Drying | 80° C. | 60 sec | |

*The replenishment rate is a rate per 1 $m^2$ of lightsensitive material.

Rinse was performed by a 4-tank countercurrent system from rinse step (4) to rinse step (1).

The composition of each processing solution was as follows.

| (Color developer) | Tank Soln. | Replenisher |
|---|---|---|
| Water | 800 mL | 800 mL |
| Ethylenediaminetetraacetic acid | 4.0 g | 4.0 g |
| Disodium 4,5-dihydroxybenzene-1,3-disulfonate | 0.5 g | 0.5 g |
| Triethanolamine | 12.0 g | 12.0 g |
| Potassium chloride | 10.0 g | — |
| Potassium bromide | 0.04 g | — |
| Potassium carbonate | 27.0 g | 27.0 g |
| Triazinyldiaminostilbene brightening agent (Hakkol FWA-SF produced by Showa Kagaku Kogyo K.K.) | 2.0 g | 5.0 g |
| Sodium sulfite | 0.1 g | 0.1 g |
| Disodium N,N-bis (sulfonatoethyl) hydroxylamine | 5.0 g | 11.5 g |
| Dimethylpolysiloxane surfactant (Silicone KF351A produced by Shin-Etsu Chemical Co., Ltd.) | 0.1 g | 0.1 g |
| N-ethyl-N-(β-methanesulfonamidoethyl)-3-methyl-4-aminoaniline 3/2 sulfate · monohydrate | 5.0 g | 16.0 g |
| Water | q.s. ad 1000 mL | |
| pH (25° C. / adjusted with potassium hydroxide and sulfuric acid) | 10.00 | 12.50 |

| | Tank soln. | Replenisher |
|---|---|---|
| (Bleach-fix soln.) | | |
| Water | 600 mL | 150 mL |
| Ammonium thiosulfate (750 g/L) | 110 mL | 220 mL |
| Ammonium sulfite | 45 g | 90 g |
| Fe(III) ammonium ethylenediaminetetraacetate | 45 g | 90 g |
| Ethylenediaminetetraacetic acid | 115 g | 3.0 g |
| Imidazole | 15 g | 30 g |
| Nitric acid (67%) | 15 g | 30 g |
| Water | q.s. ad 1000 mL | |
| pH (25° C. / adjusted with acetic acid and aqueous ammonia) | 7.0 | 6.0 |
| (Rinse solution): common to tank solution and replenisher | | |
| Sodium chloroisocyanurate | 0.02 g | |
| Deionized water (permittivity: | 5 μs/cm or less) | |
| | 1000 mL | |
| pH | 6.5 | |

Example 5

Preparation of Sample 501

A multilayered color lightsensitive material comprising a support of 127 μm-thick undercoated cellulose triacetate film and, superimposed thereon, layers of the following compositions was prepared and designated sample 501. The number indicates the addition amount per $m^2$. The effects of added compounds are not limited to described use.

| 1st layer (antihalation layer) | |
|---|---|
| Black colloidal silver | 0.10 g |
| Gelatin | 1.90 g |
| Ultraviolet absorbent U-1 | 0.10 g |
| Ultraviolet absorbent U-3 | 0.040 g |

-continued

| | |
|---|---|
| Ultraviolet absorbent U-4 | 0.10 g |
| High b.p. org. solvent Oil-1 | 0.10 g |
| Microcrystalline solid dispersion of dye E-1 | 0.10 g |
| 2nd layer (interlayer) | |
| Gelatin | 0.40 g |
| Compound Cpd-C | 5.0 mg |
| Compound Cpd-J | 5.0 mg |
| Compound Cpd-K | 3.0 mg |
| High b.p. org. solvent Oil-3 | 0.10 g |
| Dye D-4 | 0.80 mg |
| 3rd layer (interlayer) | |
| Surface and internally fogged fine grain silver iodobromide emulsion (av. grain size 0.06 μm, variation coefficient 18%, AgI content 1 mol %) | Ag qty. 0.050 g |
| Yellow colloidal silver | Ag qty. 0.030 g |
| Gelatin | 0.40 g |
| 4th layer (low-speed red-sensitive emulsion layer) | |
| Emulsion A | Ag qty. 0.30 g |
| Emulsion B | Ag qty. 0.20 g |
| Gelatin | 0.80 g |
| Coupler C-1 | 0.15 g |
| Coupler C-2 | 0.050 g |
| Coupler C-3 | 0.050 g |
| Coupler C-9 | 0.050 g |
| Compound Cpd-C | 5.0 mg |
| Compound Cpd-J | 5.0 mg |
| High b.p. org. solvent Oil-2 | 0.10 g |
| Additive P-1 | 0.10 g |
| 5th layer (medium-speed red-sensitive emulsion layer) | |
| Emulsion B | Ag qty. 0.20 g |
| Emulsion C | Ag qty. 0.30 g |
| Gelatin | 0.80 g |
| Coupler C-1 | 0.20 g |
| Coupler C-2 | 0.050 g |
| Coupler C-3 | 0.20 g |
| High b.p. org. solvent Oil-2 | 0.10 g |
| Additive P-1 | 0.10 g |
| 6th layer (high-speed red-sensitive emulsion layer) | |
| Emulsion D | Ag qty. 0.40 g |
| Gelatin | 1.10 g |
| Coupler C-1 | 0.30 g |
| Coupler C-2 | 0.10 g |
| Coupler C-3 | 0.70 g |
| Additive P-1 | 0.10 g |
| 7th layer (interlayer) | |
| Gelatin | 0.60 g |
| Additive M-1 | 0.30 g |
| Color Mixing inhibitor Cpd-I | 2.6 mg |
| Dye D-5 | 0.020 g |
| Dye D-6 | 0.010 g |
| Compound Cpd-J | 5.0 mg |
| High b.p. org. solvent Oil-2 | 0.020 g |
| 8th layer (interlayer) | |
| Surface and internally fogged silver iodobromide emulsion (av. grain size 0.06 μm, variation coefficient of 16%, AgI content 0.3 mol %) | Ag qty. 0.020 g |
| Yellow colloidal silver | Ag qty. 0.020 g |
| Gelatin | 1.00 g |
| Additive P-1 | 0.20 g |
| Color mixing inhibitor Cpd-A | 0.10 g |
| Compound Cpd-C | 0.10 g |
| 9th layer (low-speed green-sensitive emulsion layer) | |
| Emulsion E | Ag qty. 0.10 g |
| Emulsion F | Ag qty. 0.20 g |
| Emulsion G | Ag qty. 0.20 g |
| Gelatin | 0.50 g |
| Coupler C-4 | 0.10 g |
| Coupler C-7 | 0.050 g |
| Coupler C-8 | 0.10 g |

-continued

| | |
|---|---|
| Compound Cpd-B | 0.030 g |
| Compound Cpd-D | 0.020 g |
| Compound Cpd-E | 0.020 g |
| Compound Cpd-F | 0.040 g |
| Compound Cpd-J | 10 mg |
| Compound Cpd-L | 0.020 g |
| High b.p. org. solvent Oil-2 | 0.20 g |
| 10th layer (medium-speed green-sensitive emulsion layer) | |
| Emulsion G | Ag qty. 0.30 g |
| Emulsion H | Ag qty. 0.10 g |
| Gelatin | 0.60 g |
| Coupler C-4 | 0.070 g |
| Coupler C-7 | 0.050 g |
| Coupler C-8 | 0.050 g |
| Compound Cpd-B | 0.030 g |
| Compound Cpd-D | 0.020 g |
| Compound Cpd-E | 0.020 g |
| Compound Cpd-F | 0.050 g |
| Compound Cpd-L | 0.050 g |
| High. b.p. org. solvent Oil-2 | 0.010 g |
| 11th layer (high-speed green-sensitive emulsion layer) | |
| Emulsion I | Ag qty. 0.50 g |
| Gelatin | 1.00 g |
| Coupler C-4 | 0.20 g |
| Coupler C-7 | 0.10 g |
| Coupler C-8 | 0.050 g |
| Compound Cpd-B | 0.080 g |
| Compound Cpd-E | 0.020 g |
| Compound Cpd-F | 0.040 g |
| Compound Cpd-K | 5.0 mg |
| Compound Cpd-L | 0.020 g |
| High b.p. org. solvent Oil-2 | 0.040 g |
| 12th layer (interlayer) | |
| Gelatin | 0.60 g |
| Compound Cpd-L | 0.050 g |
| High b.p. org. solvent Oil-2 | 0.050 g |
| 13th layer (yellow filter layer) | |
| Yellow colloidal silver | Ag qty. 0.020 g |
| Gelatin | 1.10 g |
| Color mixing inhibitor Cpd-A | 0.010 g |
| Compound Cpd-L | 0.010 g |
| High b.p. org. solvent Oil-2 | 0.010 g |
| Microcrystalline solid dispersion of dye E-2 | 0.030 g |
| Microcrystalline solid dispersion of dye E-3 | 0.020 g |
| 14th layer (interlayer) | |
| Gelatin | 0.60 g |
| 15th layer (low-speed blue-sensitive emulsion layer) | |
| Emulsion J | Ag qty. 0.20 g |
| Emulsion K | Ag qty. 0.30 g |
| Gelatin | 0.80 g |
| Coupler C-5 | 0.20 g |
| Coupler C-6 | 0.10 g |
| Coupler C-10 | 0.40 g |
| 16th layer (medium-speed blue-sensitive emulsion layer) | |
| Emulsion L | Ag qty. 0.30 g |
| Emulsion M | Ag qty. 0.30 g |
| Gelatin | 0.90 g |
| Coupler C-5 | 0.10 g |
| Coupler C-6 | 0.10 g |
| Coupler C-10 | 0.60 g |
| 17th layer (high-speed blue-sensitive emulsion layer) | |
| Emulsion N | Ag qty. 0.20 g |
| Emulsion O | Ag qty. 0.20 g |

-continued

| | |
|---|---|
| Gelatin | 1.20 g |
| Coupler C-5 | 0.10 g |
| Coupler C-6 | 0.10 g |
| Coupler C-10 | 0.60 g |
| High b.p. org. solvent Oil-2 | 0.10 g |
| 18th layer (1st protective layer) | |
| Gelatin | 0.70 g |
| Ultraviolet absorbent U-1 | 0.20 g |
| Ultraviolet absorbent U-2 | 0.050 g |
| Ultraviolet absorbent U-5 | 0.30 g |
| Formalin scavenger Cpd-H | 0.40 g |
| Dye D-1 | 0.15 g |
| Dye D-2 | 0.050 g |
| Dye D-3 | 0.10 g |
| 19th layer (2nd protective layer) | |
| Yellow colloidal silver | Ag qty. 0.10 mg |
| Fine grain silver iodobromide emulsion (av. grain size 0.06 μm, AgI content 1 mol %) | Ag qty. 0.10 g |
| Gelatin | 0.40 g |
| 20th layer (3rd protective layer) | |
| Gelatin | 0.40 g |
| Polylmethyl methacrylate (av. grain size 1.5 μm) | 0.10 g |
| Methyl methacrylate/methacrylic acid 6:4 copolymer (av. grain size 1.5 μm) | 0.10 g |
| Silicone oil SO-1 | 0.030 g |
| Surfactant W-1 | 3.0 mg |
| Surfactant W-2 | 0.030 g |

All the above emulsion layers were doped with additives F-1 to F-8 in addition to the above components, and, further, the layers were doped with gelatin hardener H-1 and surfactants for emulsification and coating W-3, W-4, W-5 and W-6 in addition to the above components.

Moreover, phenol, 1,2-benzisothiazolin-3-one, 2-phenoxyethanol, phenethyl alcohol and butyl p-hydroxybenzoate were added as antiseptic and mildew-proofing agents.

Preparation of Dispersion of Organic Solid Dispersed Dye

Dye E-1 was dispersed by the following method. Namely, water and 200 g of Pluronic F88 (trade name for ethylene oxide/propylene oxide block copolymer) produced by BASF were added to 1430 g of dye wet cake containing 30% of methanol and agitated, thereby obtaining a slurry having a dye content of 6%. 1700 mL of zirconia beads having an average grain size of 0.5 mm were charged into Ultravis-comill (UVM-2) manufac-tured by Aimex Co., Ltd. and the slurry was milled at a peripheral speed of about 10 m/sec and a delivery of 0.5 L/min for 8 hr. The beads were removed by filtration and the slurry was diluted with water into a dye content of 3%. The dilution was heated at 90° C. for 10 hr for stabilization. The obtained dye fine grains had an average grain size of 0.60 μm and a grain size distribution breadth (standard deviation of grain sizes×100/average grain size) of 18%.

Solid dispersions of dyes E-2 and E-3 were obtained in the same manner. The average grain sizes thereof were 0.54 μm and 0.56 μm, respectively.

TABLE 6

Silver bromoiodide emulsions used in Sample 501 are as follows

| Emulsion | Characteristics of grains | Average equivalent spherical diameter (μm) | Coefficient of variation (%) | AgI content (%) |
|---|---|---|---|---|
| A | Monodisperse tetradecahedral grains | 0.28 | 16 | 4.0 |
| B | Monodisperse cubic internally fogged grains | 0.30 | 10 | 4.0 |
| C | Monodisperse cubic grains | 0.38 | 10 | 5.0 |
| D | Monodisperse tabular grains Av.asp.rt.:3.0 | 0.68 | 8 | 2.0 |
| E | Monodisperse cubic grains | 0.20 | 17 | 4.0 |
| F | Monodisperse tetradecahedral grains | 0.25 | 16 | 4.0 |
| G | Monodisperse cubic internally fogged grains | 0.40 | 11 | 4.0 |
| H | Monbodisperse cubic grains | 0.50 | 9 | 3.5 |
| I | Monodisperse tabular grains Av.asp.rt.:5.0 | 0.80 | 10 | 2.0 |
| J | Monodisperse cubic grains | 0.30 | 18 | 4.0 |
| K | Mododisperse tetradecahedral grains | 0.45 | 17 | 4.0 |
| L | Monodisperse tabular grains Av.asp.rt.:5.0 | 0.55 | 10 | 2.0 |
| M | Monodisperse tabular grains Av.asp.rt.:8.0 | 0.70 | 13 | 2.0 |
| N | Monodisperse tabular grains Av.asp.rt.:6.0 | 1.00 | 10 | 1.5 |
| O | Monodisperse tabular grains Av.asp.rt.:9.0 | 1.20 | 15 | 1.5 |

Av.asp.rat. = Average aspect ratio

TABLE 7

Spectral sensitization of emulsions A to O

| Emulsion | Spectral sensitizers added | Addition amount per mol of silver halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |

TABLE 7-continued

Spectral sensitization of emulsions A to O

| Emulsion | Spectral sensitizers added | Addition amount per mol of silver halide (g) |
|---|---|---|
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |
| J | S-6 | 0.050 |
| | S-7 | 0.20 |
| K | S-6 | 0.05 |

TABLE 7-continued

Spectral sensitization of emulsions A to O

| Emulsion | Spectral sensitizers added | Addition amount per mol of silver halide (g) |
|---|---|---|
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

C-1

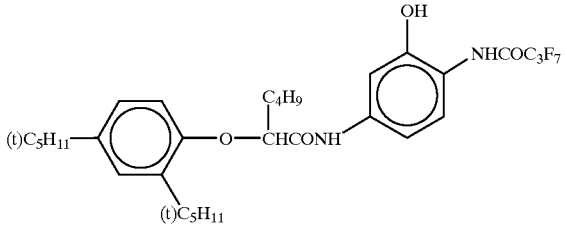

C-2

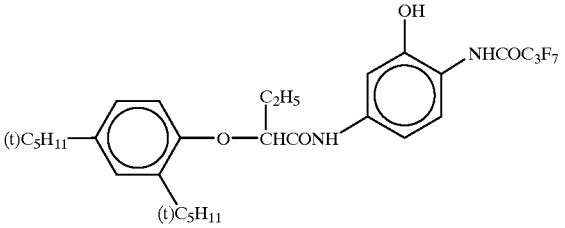

C-3

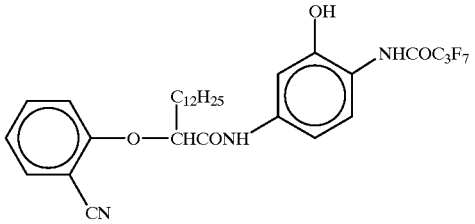

C-4

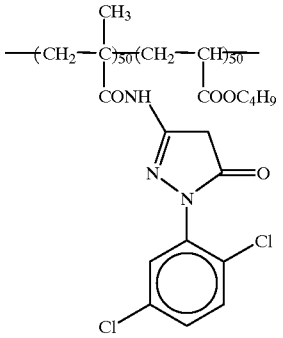

The number is in wt%
Av. mol. wt: about 25,000

-continued
C-5
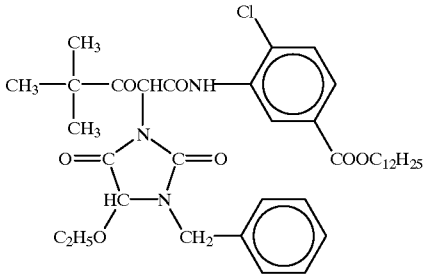
C-6
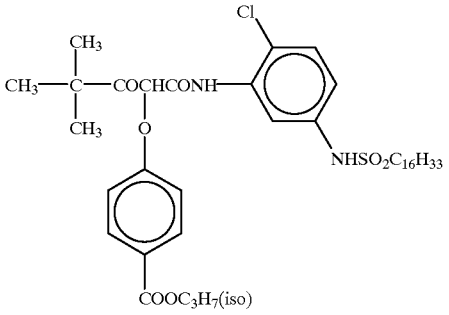
C-7
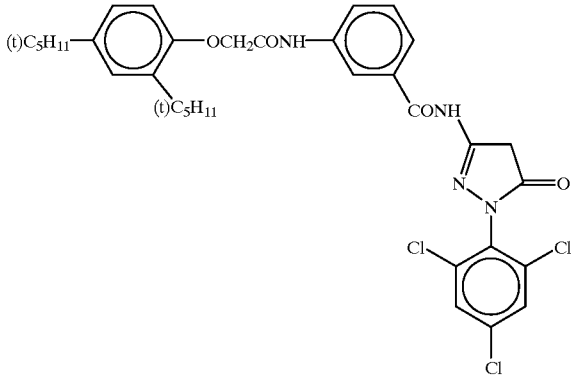
C-8
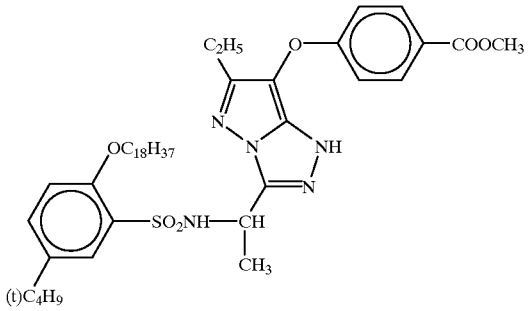
C-9
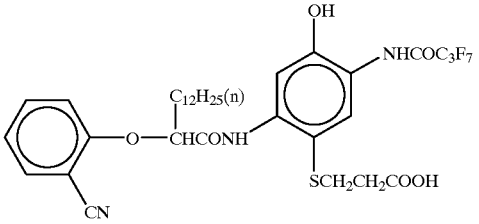
C-10
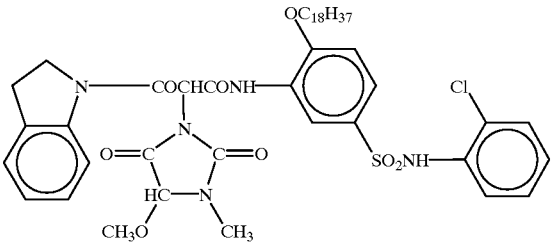
Oil-1
Dibutyl phathalate
Oil-2
tricresyl phosphate
Oil-3
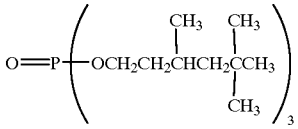
Cpd-A
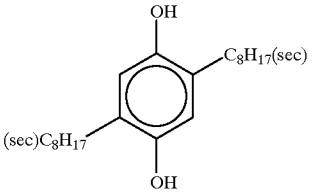
Cpd-B
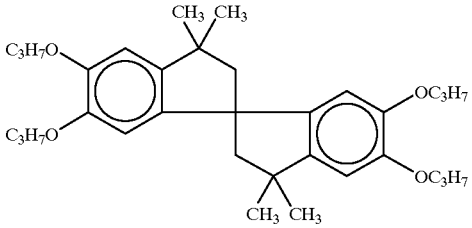
Cpd-C
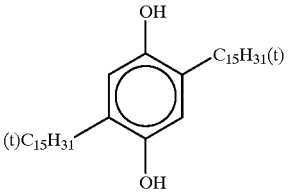

-continued
Cpd-D
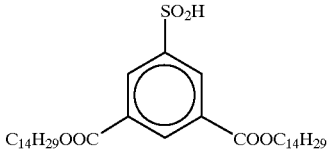
Cpd-E
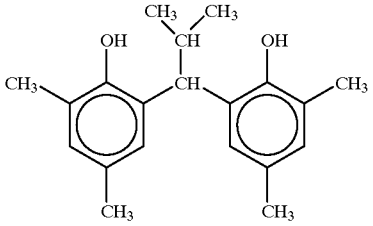
Cpd-F
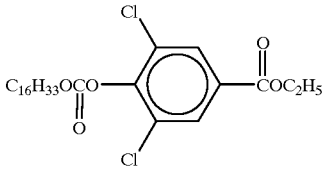
Cpd-H
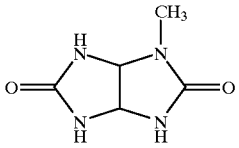
Cpd-I
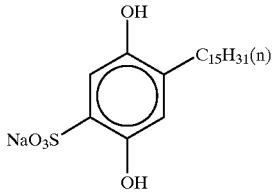
Cpd-J
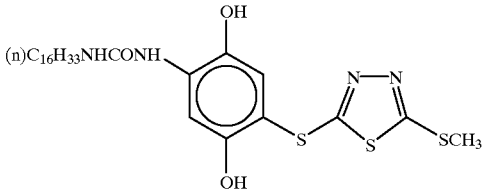
Cpd-K
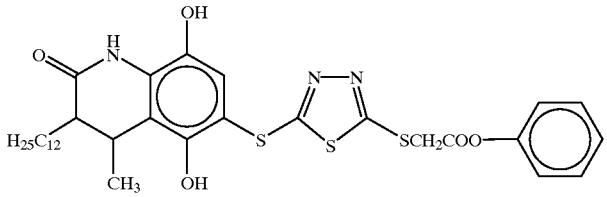
Cpd-L
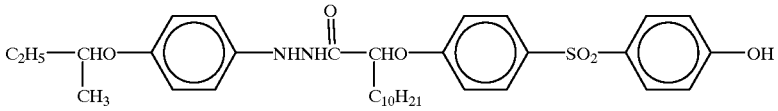
U-1
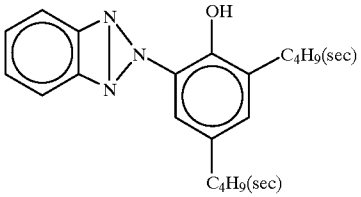
U-2
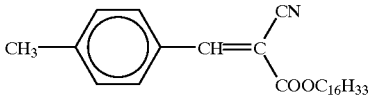
U-3
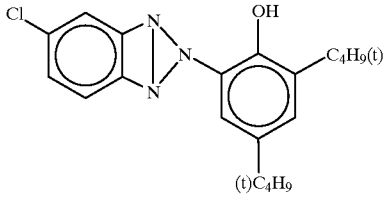
U-4
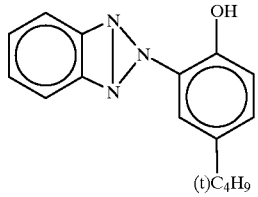

-continued
U-5
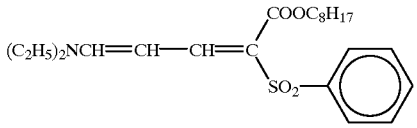
S-1
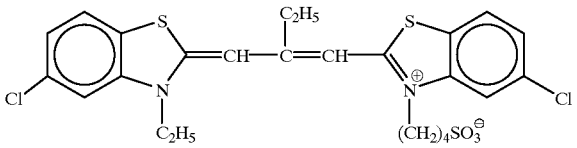
S-2
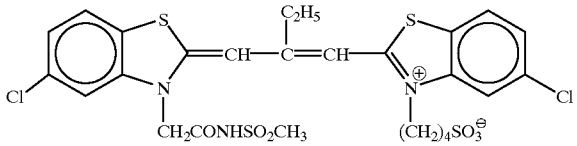
S-3
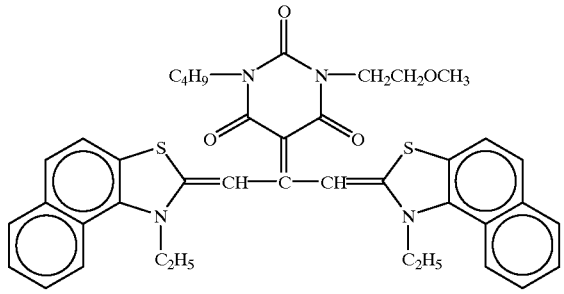
S-4
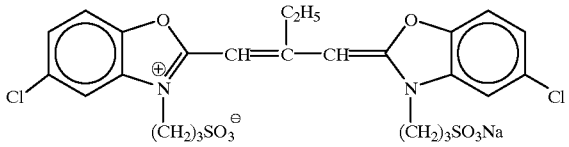
S-5
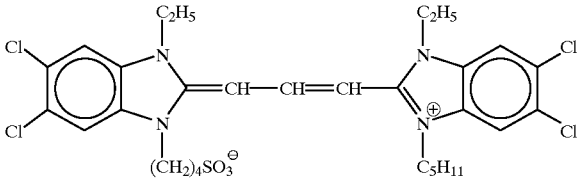
S-6
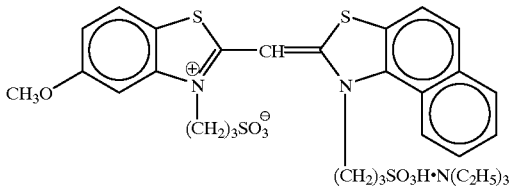
S-7
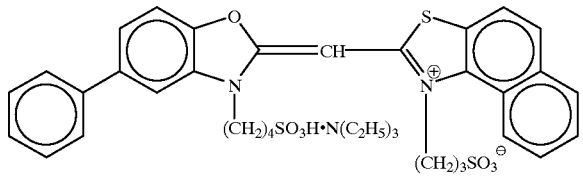
S-8
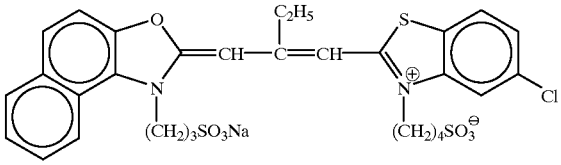
S-9
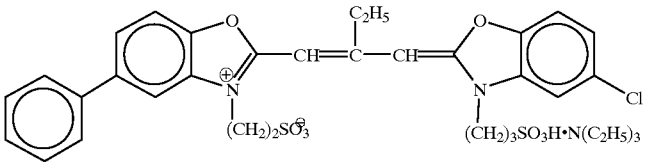

-continued
D-1
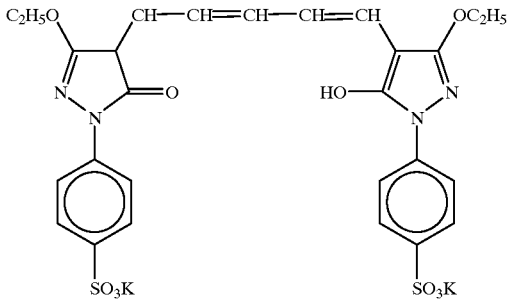
D-2
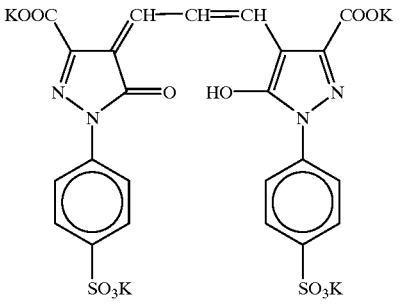
D-3
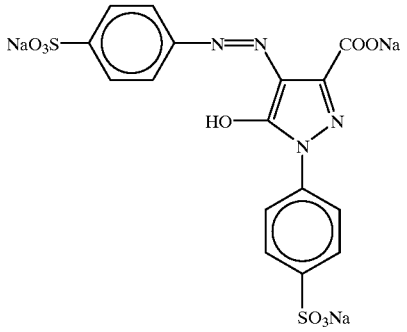
D-4
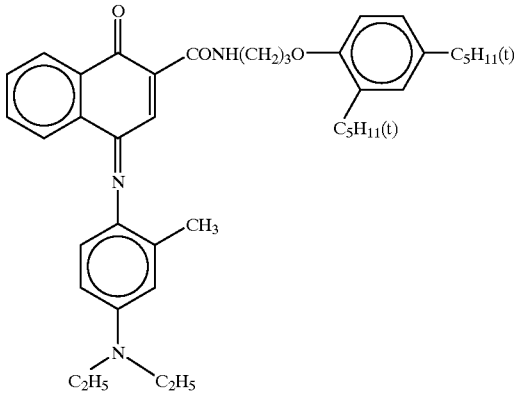
D-5
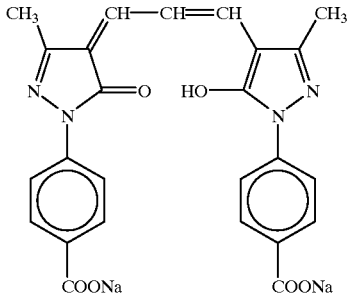
D-6
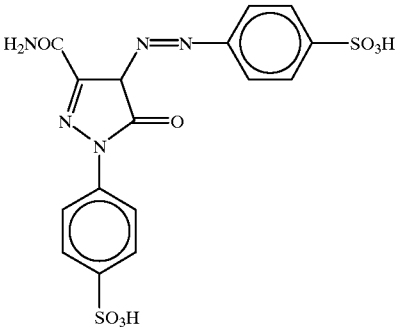
E-1
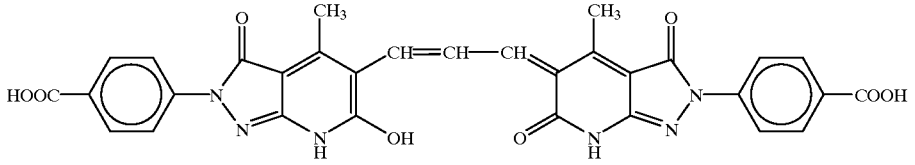
E-2
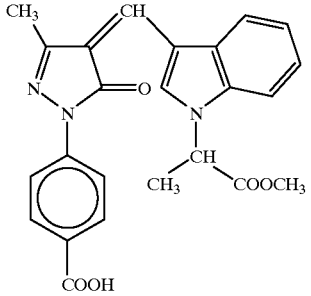
E-3
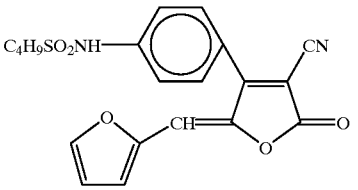

-continued
H-1
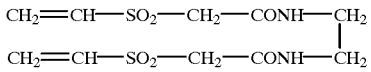
W-1
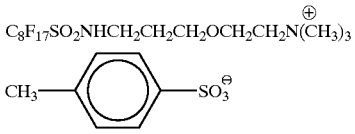
W-2
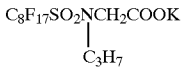
W-3
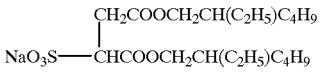
W-4
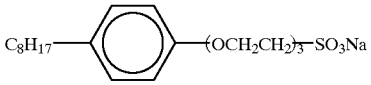
W-5
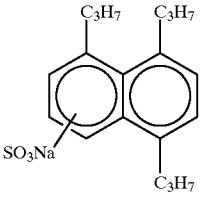
W-6
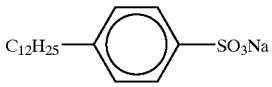
P-1
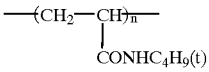
(n = 100–1000)
P-2
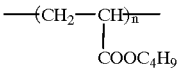
(n = 100–1000)
SO-1
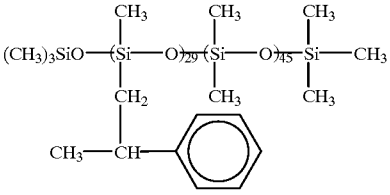
F-1
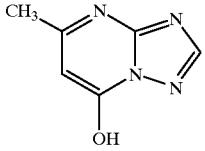
F-2
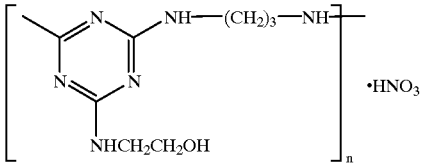
(n = 3–4)
F-3
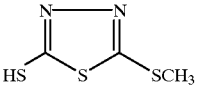
F-4
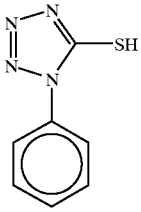

-continued

F-5

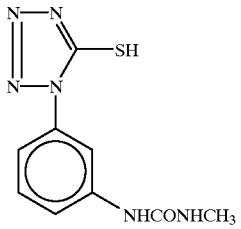

F-6

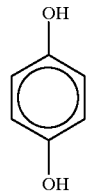

F-7

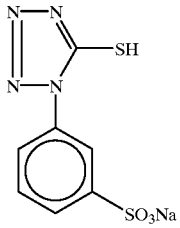

F-8

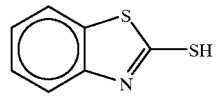

Samples 502 to 508 were prepared in the same manner as in the preparation of Sample 501, except that each of the high-boiling-point organic solvent Oil-2 contained in the 7th, 12th and 17th layers of Sample 501 was replaced by the same weight of each of the high-boiling-point organic solvents 1, 2, 3, 4, 6, 12 and 20 of the present invention, respectively.

The Samples 501 to 508 were subjected to wedge exposure conducted with the use of white light and thereafter to the following development processing. The densities of the processed samples were measured, and the resistance to light of yellow image was tested.

The results of the test showed the suppression of color mixing and the improvement of the resistance to light of yellow image with respect to the samples of the present invention.

The method of development processing will be described below.

| Step | Time (min) | Temp. (° C.) | Tank vol. (L) | Replenishment rate (mL/m$^2$) |
|---|---|---|---|---|
| 1st. development | 6 | 38 | 12 | 2200 |
| 1st water washing | 2 | 38 | 4 | 7500 |
| reversal | 2 | 38 | 4 | 1100 |
| color development | 6 | 38 | 12 | 2200 |
| prebleaching | 2 | 38 | 4 | 1100 |
| bleaching | 6 | 38 | 12 | 220 |
| fixing | 4 | 38 | 8 | 1100 |
| 2nd water washing | 4 | 38 | 8 | 7500 |
| final rinse | 1 | 25 | 2 | 1100 |

The composition of each processing solution was as follows.

| | Tank soln. | Replenisher |
|---|---|---|
| (1st development solution) | | |
| pentasodium nitrilo-N,N,N-trimethylene-phosphonate | 1.5 g | 1.5 g |
| pentasodium diethylenetriamine-pentacetate | 6.0 g | 6.0 g |
| sodium sulfite | 30 g | 30 g |
| hydroquinone/potassium monosulfonate | 23 g | 23 g |
| potassium carbonate | 15 g | 20 g |
| sodium bicarbonate | 12 g | 15 g |
| 1-phenyl-4-methyl-4-hydroxymethyl-3-pyrazolidone | 1.5 g | 2.0 g |
| potassium bromide | 2.5 g | 1.4 g |
| potassium thiocyanate | 1.2 g | 1.2 g |
| potassium iodide | 2.0 mg | — |
| diethylene glycol | 13 g | 15 g |
| water | q.s. ad 1000 mL | |
| pH | 9.60 | 9.60 |
| This pH was adjusted by the use of sulfuric acid or potassium hydroxide. | | |
| (reversal solution) | | |
| pentasodium nitrilo-N,N,N-trimethylene-phosphonate | 3.0 g | same as left |
| stannous chloride dihydrate | 1.9 g | " |
| p-aminophenol | 1 mg | " |
| sodium hydroxide | 8 g | " |
| glacial acetic acid | 15 mL | " |
| water | q.s. ad 1000 mL | |
| pH | 6.00 | same as left |

This pH was adjusted by the use of acetic acid or sodium hydroxide.

| | Tank soln. | Replenisher |
|---|---|---|
| (Color developer) | | |
| pentasodium nitrilo-N,N,N-trimethylene-phosphonate | 7.0 g | 7.0 g |
| sodium sulfite | 7.0 g | 7.0 g |

-continued

| | Tank soln. | Re-plenisher |
|---|---|---|
| trisodium phosphate dodecahydrate | 36 g | 36 g |
| potassium bromide | 0.7 g | — |
| potassium iodide | 40 mg | — |
| sodium hydroxide | 3.0 g | 3.0 g |
| citrazinic acid | 0.6 g | 0.6 g |
| N-ethyl-N-(β-methanesulfonamidoethyl)-3-methyl-4-aminoaniline 3/2 sulfate monohydrate | 11 g | 11 g |
| 3,6-dithiaoctane-1,8-diol | 1.0 g | 1.0 g |
| water | q.s. ad 1000 mL | |
| pH | 11.80 | 12.00 |
| This pH was adjusted by the use of sulfuric acid or potassium hydroxide. | | |
| (Prebleaching) | | |
| disodium ethylenediaminetetraacetate dihydrate | 8.0 g | 8.0 g |
| sodium sulfite | 6.0 g | 8.0 g |
| 1-thioglycerol | 0.4 g | 0.4 g |
| formaldehyde/sodium bisulfite adduct | 30 g | 35 g |
| water | q.s. ad 1000 mL | |
| pH | 6.30 | 6.10 |
| This pH was adjusted by the use of acetic acid or sodium hydroxide. | | |
| (Bleaching soln.) | | |
| disodium ethylenediaminetetraacetate dihydrate | 2.0 g | 4.0 g |
| Fe(III) ammonium ethylenediaminetetraacetate dihydrate | 120 g | 240 g |
| potassium bromide | 100 g | 200 g |
| ammonium nitrate | 10 g | 20 g |
| water | q.s. ad 1000 mL | |
| pH | 5.70 | 5.50 |

This pH was adjusted by the use of nitric acid or sodium hydroxide.

| (Fixing solution) | Tank soln. | Re-plenisher |
|---|---|---|
| ammonium thiosulfate | 80 g | same as left |
| sodium sulfite | 5.0 g | same as left |
| sodium bisulfite | 5.0 g | " |
| water | q.s. ad 1000 mL | |
| pH | 6.60 | same as left |

This pH was adjusted by the use of acetic acid or aqueous ammonia.

| (Stabilizer) | Tank soln. | Replenisher |
|---|---|---|
| 1,2-benzoisothiazolin-3-one | 0.02 g | 0.03 g |
| polyoxyethylene p-monononylphenyl ether (av. deg. of polymn. 10) | 0.3 g | 0.3 g |
| polymaleic acid (av. mol. wt. 2,000) | 0.1 g | 0.15 g |
| water | q.s. ad 1000 mL | |
| pH | 7.0 | 7.0 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A silver halide photographic lightsensitive material comprising at least one silver halide emulsion layer on a support, wherein said lightsensitive material contains at least one hydrophilic colloid layer containing at least one compound represented by the following general formula (1):

(I)

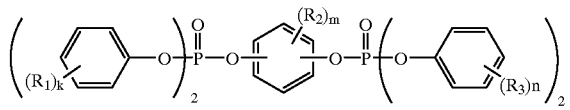

wherein each of $R_1$, $R_2$ and $R_3$ independently represents an alkyl group, a linear or branched alkenyl group having 2 to 32 carbon atoms, a linear or branched alkynyl group having 2 to 32 carbon atom, a cycloalkenyl group having 3 to 32 carbon atoms, a cycloalkenyl group having 3 to 32 carbon atoms, an aryl group, a halogen atom, a heterocyclic group, a cyano group, a hydroxy group, a nitro group, a carboxyl group, a sulfo group, an amino group, an alkoxy group, an aryloxy group, an acylamino group, an alkylamino group, an anilino group, an ureido group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxcarbonylamino group, an imido group, a sulfinyl group, an aryloxycarbonyl group or an acyl group; each of k and n independently represents an integer of 0 to 5; and m represents an integer of 0 to 4.

2. The material according to claim 1, wherein each of $R_1$, $R_2$ and $R_3$ of the formula (1) independently represents an alkyl group, an aryl group, an alkoxy group or a halogen atom.

3. The material according to claim 2, wherein each of $R_1$, $R_2$ and $R_3$ of the formula (1) independently represents a methyl group, an ethyl group, a phenyl group, a methoxy group or a chlorine atom.

4. The material according to claim 2, wherein each of k, m and n of the formula (1) independently represents 0 or 1, and the substitution position of $R_1$ with respect to the oxygen atom that attaches to the phosphorous atom is the same as the substitution position of $R_3$ with respect to the oxygen atom that attaches to the phosphorous atom.

5. The material according to claim 4, wherein the compound represented by formula (1) is represented by the formula (1-m):

(1-m)

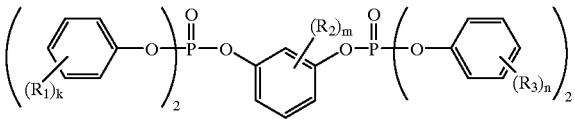

wherein each of k, m, and n independently represents 0 or 1; and each of $R_1$, $R_2$ and $R_3$ independently represents an alkyl group, an aryl group, an alkoxy group or a halogen atom.

6. The material according to claim 5, wherein each of $R_1$, $R_2$ and $R_3$ of the formula (1-m) independently represents a methyl group, an ethyl group, a phenyl group, a methoxy group or a chlorine atom.

7. The material according to claim 1, wherein the substitution position of $R_1$ with respect to the oxygen atom that attaches to the phosphorous atom is the same as the substitution position of $R_3$ with respect to the oxygen atom that attaches to the phosphorous atom.

8. The material according to claim 1, wherein each of k, m and n of the formula (1) independently represents 0 or 1.

9. The material according to claim 1, wherein the compound represented by the formula (1) is represented by formula (1-m) having m-phenylene group:

(1-m)

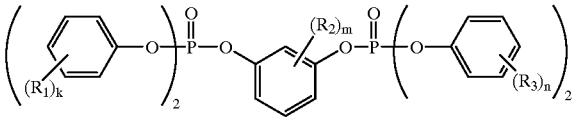

wherein each of $R_1$, $R_2$, $R_3$, k, m, and n is the same as defined for the formula (1).

10. The material according to claim 1, wherein each of $R_1$ and $R_3$ of the formula (1) independently represents a phenyl group, a methoxy group or a chlorine atom; $R_2$ represents a methyl group, a methoxy group or a chlorine atom; k and n are the same and represent 0 or 1; and m represents 0 or 1.

11. The material according to claim 1, wherein the compound represented by the formula (1) is

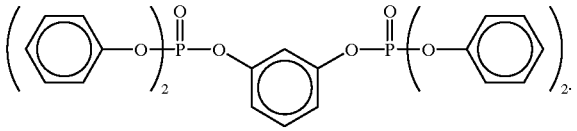

12. The material according to claim 1, wherein an addition amount of the compound represented by the formula (1) is 0.2 mg to 20 g per $m^2$ of the material.

13. The material according to claim 1, wherein a photographically useful compound is contained in the same layer as the layer to which the compound represented by the formula (1) is contained; and a weight ratio of the compound represented by the formula (1) with respect to the photographically useful compound is in a range of 0.1 to 4.

14. The material according to claim 1, wherein the hydrophilic colloid layer is at least one of a red-sensitive colloid layer, a green-sensitive colloid layer, or a blue-sensitive colloid layers.

15. The material according to claim 1, wherein the addition amount of the compound represented by the formula (1) is 1 mg to 5 g per $m^2$ of the material.

16. The material according to claim 1, wherein the hydrophilic colloid layers have a total dried film thickness of 2–20 microns.

* * * * *